US008340804B2

(12) United States Patent
Yamada et al.

(10) Patent No.: US 8,340,804 B2
(45) Date of Patent: Dec. 25, 2012

(54) EMBROIDERY DATA CREATION APPARATUS AND NON-TRANSITORY COMPUTER-READABLE MEDIUM STORING EMBROIDERY DATA CREATION PROGRAM

(75) Inventors: Kenji Yamada, Nagoya (JP); Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 106 days.

(21) Appl. No.: 13/099,048

(22) Filed: May 2, 2011

(65) Prior Publication Data

US 2011/0295410 A1 Dec. 1, 2011

(30) Foreign Application Priority Data

May 26, 2010 (JP) ..... 2010-120224

(51) Int. Cl.
*D05C 5/02* (2006.01)

(52) U.S. Cl. ..... 700/138; 112/470.01

(58) Field of Classification Search ..... 700/136–138; 112/102.5, 445, 470.01, 470.04, 470.06, 112/475.18, 475.19
See application file for complete search history.

(56) References Cited

U.S. PATENT DOCUMENTS

| | | | | |
|---|---|---|---|---|
| 5,791,271 | A * | 8/1998 | Futamura | 112/102.5 |
| 5,839,380 | A * | 11/1998 | Muto | 112/102.5 |
| 6,510,360 | B1 * | 1/2003 | Kaymer et al. | 700/138 |
| 6,629,015 | B2 * | 9/2003 | Yamada | 700/138 |
| 7,854,207 | B2 * | 12/2010 | Kuki et al. | 112/102.5 |
| 2002/0038162 | A1 | 3/2002 | Yamada | |
| 2008/0289553 | A1 | 11/2008 | Yamada | |
| 2009/0188415 | A1 * | 7/2009 | Tokura | 112/470.01 |
| 2010/0228383 | A1 * | 9/2010 | Taguchi | 700/138 |

FOREIGN PATENT DOCUMENTS

| | | |
|---|---|---|
| JP | A-8-3858 | 1/1996 |
| JP | A-10-314471 | 12/1998 |
| JP | A-2001-259268 | 9/2001 |
| JP | A-2008-289517 | 12/2008 |
| JP | A-2010-39662 | 2/2010 |

* cited by examiner

*Primary Examiner* — Nathan Durham
(74) *Attorney, Agent, or Firm* — Oliff & Berridge, PLC

(57) ABSTRACT

An embroidery data creation apparatus includes a storage portion that stores pattern information for a first pattern, a first point specification portion that specifies first feature points, a first area specification portion that specifies first partitioned areas bounded by line segments linking the first feature points, an image acquisition portion that acquires a second image, a second point specification portion that specifies second feature points that correspond to the respective first feature points, a second area specification portion that specifies second partitioned areas bounded by line segments linking the second feature points, a conversion portion that, based on positional relationships between the first and second feature points, converts information of the pattern information that corresponds to the first partitioned areas into information that corresponds to the plurality of second partitioned areas, and a first creation portion that creates embroidery data for sewing the second pattern based on the information.

22 Claims, 29 Drawing Sheets

FIG. 3

1511

| FIRST PATTERN | FIRST IMAGE | PATTERN INFORMATION |
|---|---|---|
| R | U | X |
| S | V | Y |
| T | W | Z |
| : | : | : |

EMBROIDERY DATA CREATION APPARATUS AND NON-TRANSITORY COMPUTER-READABLE MEDIUM STORING EMBROIDERY DATA CREATION PROGRAM

CROSS-REFERENCE TO RELATED APPLICATION

This application claims priority to Japanese Patent Application No. 2010-120224, filed May 26, 2010, the disclosure of which is hereby incorporated by reference in its entirety.

BACKGROUND

The present disclosure relates to an embroidery data creation apparatus that creates embroidery data for sewing an embroidery pattern using an embroidery sewing machine and to a non-transitory computer-readable medium that stores an embroidery data creation program.

An embroidery data creation apparatus is known that acquires image data from an image such as a photograph, an illustration, or the like and based on the image data, creates embroidery data for sewing an embroidery pattern. The embroidery data may be created by the following procedure, for example. First, line segment data that indicate the shapes and relative positions of the stitches are created based on the image data. Thread color data that indicate the colors of the stitches are assigned to the data for the respective line segments. Next, in a case where a plurality of line segments exist that are represented by the line segment data to which the same thread color data have been assigned, connected line segment data are created that represent a connected line segment that includes the line segments that have been connected. Based on the connected line segment data that have been created, embroidery data are created that indicate the sewing sequence, the thread colors, the needle drop points, and the types of stitches.

SUMMARY

The finished quality of a sewn embroidery pattern may differ greatly, depending on the precise way that the threads are arranged. With the method that is described above, cases may occur in which the arrangement of the line segments that are represented by the line segment data that are created from the image data is subtly different from the arrangement of the threads in the ideal embroidery pattern. In these cases, if the sewing is performed based on the embroidery data that have been created, it is possible that the finished quality of the sewn embroidery pattern will be undesirable.

Various exemplary embodiments of the broad principles derived herein provide an embroidery data creation apparatus, as well as a non-transitory computer-readable medium that stores an embroidery data creation program, that creates embroidery data for sewing an embroidery pattern with a good finished quality that approximates the ideal embroidery pattern.

Exemplary embodiments herein provide an embroidery data creation apparatus that includes a storage portion, a first point specification portion, a first area specification portion, an image acquisition portion, a second point specification portion, a second area specification portion, a conversion portion, and a first creation portion. The storage portion stores pattern information. The pattern information is information that characterizes a first pattern that is a model embroidery pattern. The first point specification portion specifies a plurality of first feature points. Each of the plurality of first feature points is a feature point in one of the first pattern and a first image. The first image is an image that serves as a basis for the first pattern. The first area specification portion specifies a plurality of first partitioned areas. Each of the plurality of first partitioned areas is an area that is bounded by a plurality of first point linking line segments. Each of the plurality of first point linking line segments is a line segment that links two of the plurality of first feature points specified by the first point specification portion. The image acquisition portion acquires a second image. The second image is an image that serves as a basis for a second pattern. The second pattern is an embroidery pattern that is actually to be sewn. The second point specification portion specifies a plurality of second feature points. Each of the plurality of second feature points is a feature point in the second image acquired by the image acquisition portion. Positions of the plurality of second feature points respectively correspond to positions of the plurality of first feature points. The second area specification portion specifies a plurality of second partitioned areas. Each of the plurality of second partitioned areas is an area that is bounded by a plurality of second point linking line segments. Each of the plurality of second point linking line segments is a line segment that links two of the plurality of second feature points specified by the second point specification portion. The conversion portion, based on positional relationships between the plurality of first feature points and the plurality of second feature points that respectively correspond to the plurality of first feature points, selects information included in the pattern information stored in the storage portion that corresponds to each of the plurality of first partitioned areas specified by the first area specification portion and converts the selected information into information that corresponds to each of the plurality of second partitioned areas specified by the second area specification portion. The first creation portion creates embroidery data for sewing the second pattern, based on the information that has been acquired by converting by the conversion portion and that corresponds to the plurality of second partitioned areas.

Exemplary embodiments also provide a non-transitory computer-readable medium that stores an embroidery data creation program. The embroidery data creation program includes instructions that, when executed, cause a computer to perform the steps of specifying a plurality of first feature points, each of the plurality of first feature points being a feature point in one of a first pattern and a first image, the first pattern being a model embroidery pattern, the first image being an image that serves as a basis for the first pattern, specifying a plurality of first partitioned areas, each of the plurality of first partitioned areas being an area that is bounded by a plurality of first point linking line segments, each of the plurality of first point linking line segments being a line segment that links two of the plurality of first feature point, acquiring a second image, the second image being an image that serves as a basis for a second pattern, the second pattern being an embroidery pattern that is actually to be sewn, specifying a plurality of second feature points, each of the plurality of second feature points being a feature point in the second image and positions of the plurality of second feature points respectively corresponding to positions of the plurality of first feature points, specifying a plurality of second partitioned areas, each of the plurality of second partitioned areas being an area that is bounded by a plurality of second point linking line segments, each of the plurality of second point linking line segments being a line segment that links two of the plurality of second feature points, selecting information that is included in pattern information stored in a storage portion and that corresponds to each of the plurality of first partitioned areas and converting the selected information into information that corresponds to each of the plurality of second partitioned areas, based on positional relationships between the plurality of first feature points and the plurality of second feature points that respectively correspond to the plurality of first feature points, the pattern information being information that characterizes the first pattern, and creating embroidery data for sewing the second pattern, based on the information that has been acquired by converting and that corresponds to the plurality of second partitioned areas.

BRIEF DESCRIPTION OF THE DRAWINGS

Exemplary embodiments will be described below in detail with reference to the accompanying drawings in which:

FIG. 3 is an explanatory figure of a pattern table 1511;

DETAILED DESCRIPTION

First Embodiment

Hereinafter, a first embodiment of the present invention will be explained with reference to the drawings in order. The drawings will be used to explain technical features that the present invention can utilize. The configuration of the apparatus that is described, the flowcharts for the various types of processing, and the like are merely examples.

Figure 1:
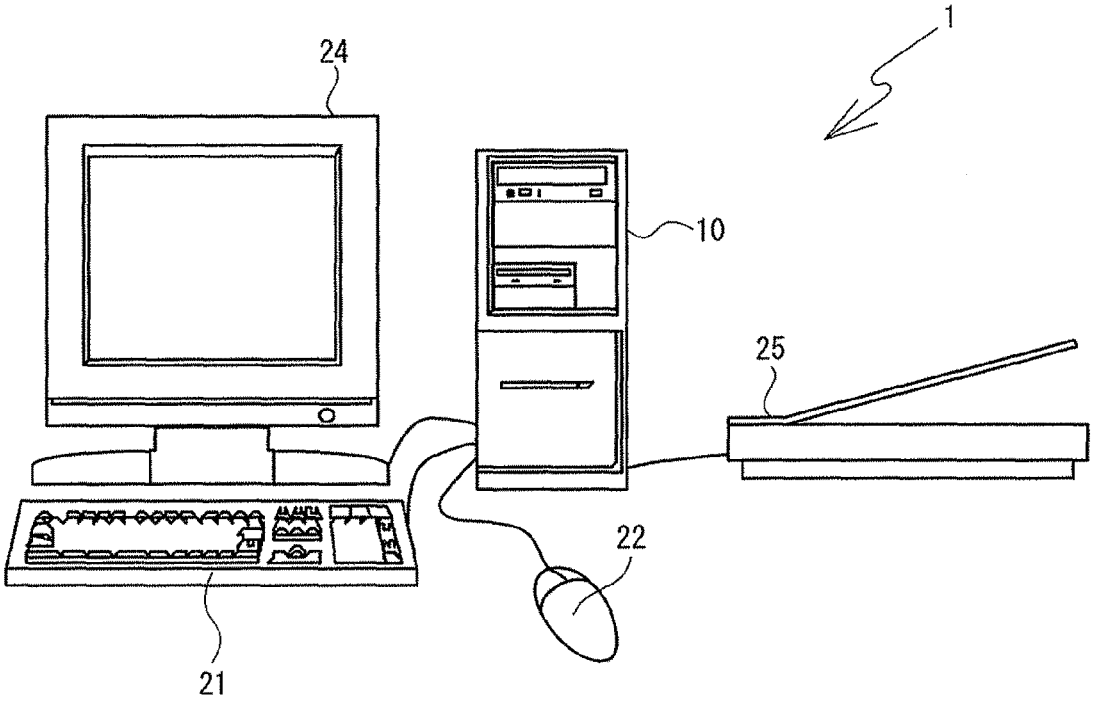
FIG. 1 is a general configuration diagram that shows a physical configuration of an embroidery data creation apparatus 1.

A configuration of an embroidery data creation apparatus 1 will be explained with reference to FIG. 1. The embroidery data creation apparatus 1 is an apparatus that creates embroidery data. The embroidery data are data that are used when an embroidery pattern is sewn by a sewing machine that is capable of embroidery sewing, such as an embroidery sewing machine 3 (refer to FIG. 6), which will be described later. Based on image data that are taken from an image such as a photograph, an illustration, or the like, the embroidery data creation apparatus 1 can create embroidery data for sewing an embroidery pattern that depicts the image. As shown in FIG. 1, the embroidery data creation apparatus 1 includes a main unit 10, a keyboard 21, a mouse 22, a display 24, and an image scanner 25. The keyboard 21, the mouse 22, the display 24, and the image scanner 25 are connected to the main unit 10. The main unit 10 may be a general-purpose device such as a personal computer or the like.

Figure 2:
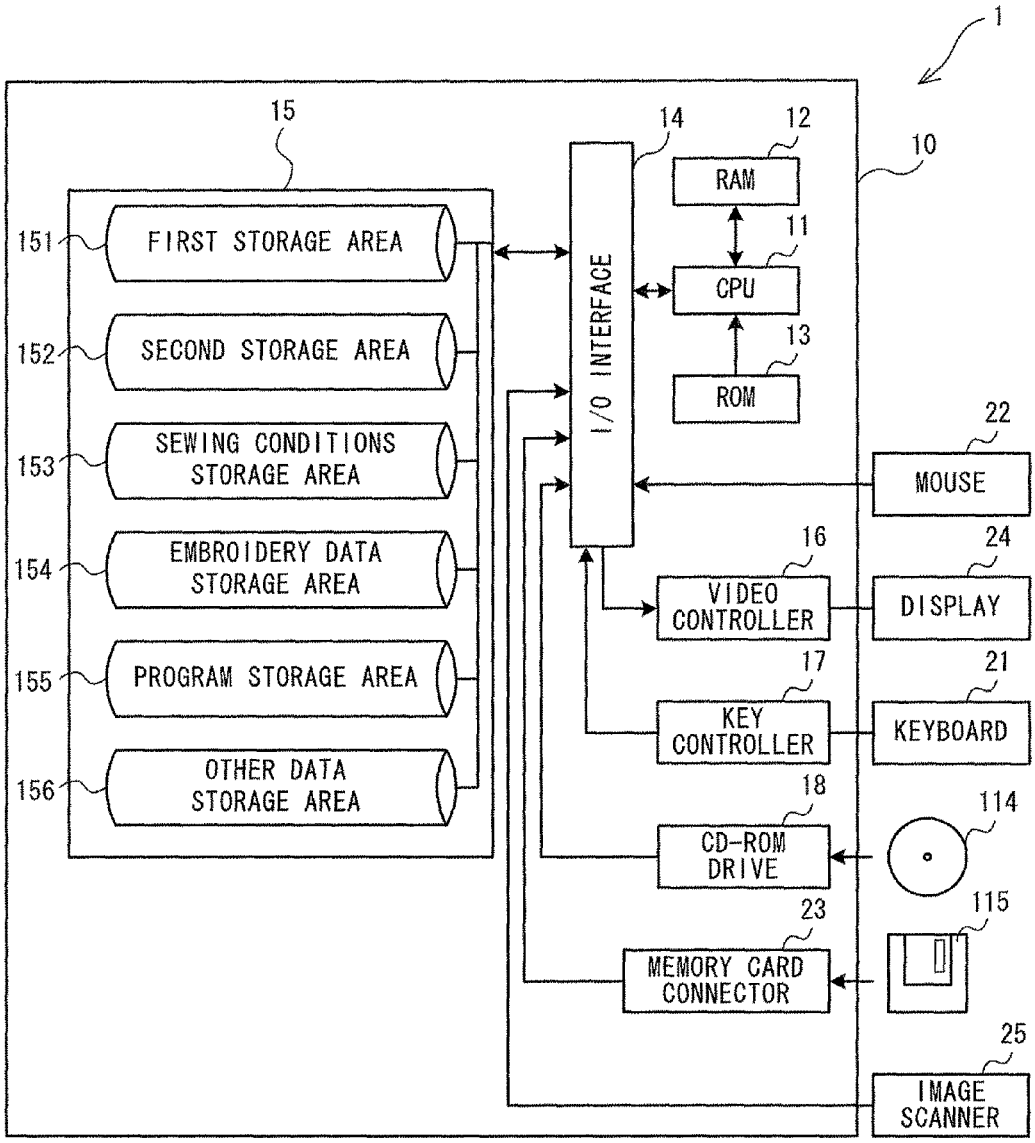
FIG. 2 is a block diagram of an electrical configuration of the embroidery data creation apparatus 1.

An electrical configuration of the embroidery data creation apparatus 1 will be explained with reference to FIG. 2. As shown in FIG. 2, the main unit 10 includes a CPU 11. The CPU 11 is a controller that performs overall control of the main unit 10. A RAM 12, a ROM 13, and an input/output (I/O) interface 14 are connected to the CPU 11. The RAM 12 stores various types of data temporarily. The ROM 13 stores a BIOS and the like. The I/O interface 14 serves as a mediator of data transfers. A hard disk drive (HDD) 15, the mouse 22, a video controller 16, a key controller 17, a CD-ROM drive 18, a memory card connector 23, and the image scanner 25 are connected to the I/O interface 14. The display 24 is connected to the video controller 16. The keyboard 21 is connected to the key controller 17. The main unit 10 may also include an external interface for connecting to an external device or a network, although this is not shown in FIG. 2.

A CD-ROM 114 can be inserted into the CD-ROM drive 18. For example, when an embroidery data creation program is set up, the CD-ROM 114, which stores the embroidery data creation program, is inserted into the CD-ROM drive 18. The embroidery data creation program is then read and is stored in a program storage area 155 of the HDD 15. A memory card 115 can be connected to the memory card connector 23. The CPU 11 can read and write information from and to the memory card 115.

The HDD 15 is provided with a first storage area 151, a second storage area 152, a sewing conditions storage area 153, an embroidery data storage area 154, the program storage area 155, and an other data storage area 156.

Figure 4:
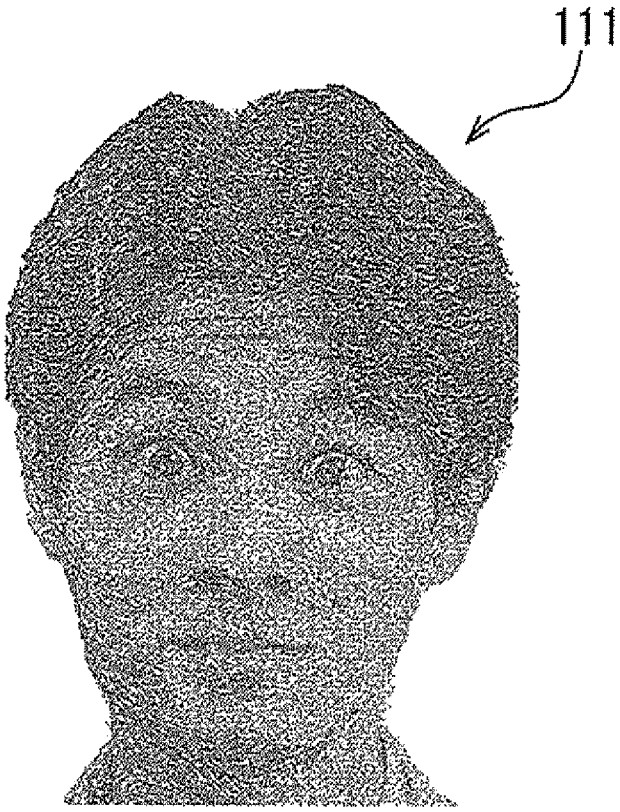
FIG. 4 is a figure that shows a first pattern 111.

A pattern table is stored in the first storage area 151. A plurality of items of information that are related to model embroidery patterns, and which are referenced when the embroidery data are created, are stored in the pattern table. A pattern table 1511 that is an example of the pattern table will be explained with reference to FIG. 3. A plurality of data items for first patterns, first images, and pattern information are stored in association with one another in the pattern table 1511. The first patterns (R, S, T) are images that show the external appearances of the model embroidery patterns when they are sewn. The first images (U, V, W) are images of photographs, illustrations, and the like that serve as the basis for the first patterns. The pattern information (X, Y, Z) includes information sets that each characterizes the corresponding first pattern. In the first embodiment, the pattern information includes information on needle drop points, information on a sewing sequence, and information on colors of thread for sewing the first patterns. For example, the data for a first pattern 111 that is shown in FIG. 4 are stored in the pattern table 1511. The information on the needle drop points, the sewing sequence, and the thread colors for sewing the first pattern 111 are stored as the pattern information in the pattern table 1511.

In the present embodiment, data for first patterns that depict human faces, as does the first pattern 111 that is shown as an example in FIG. 4, are stored in the pattern table. The reason for taking the human faces is that for embroidery patterns of human faces, users generally demand a high level of image reproduction and finished quality. Accordingly, an embroidery pattern that is sewn based on embroidery data that are created in main processing that will be described later, using a first pattern that depicts a human face as the model embroidery pattern can have a good finished quality that satisfies the users' demands.

Figure 5:
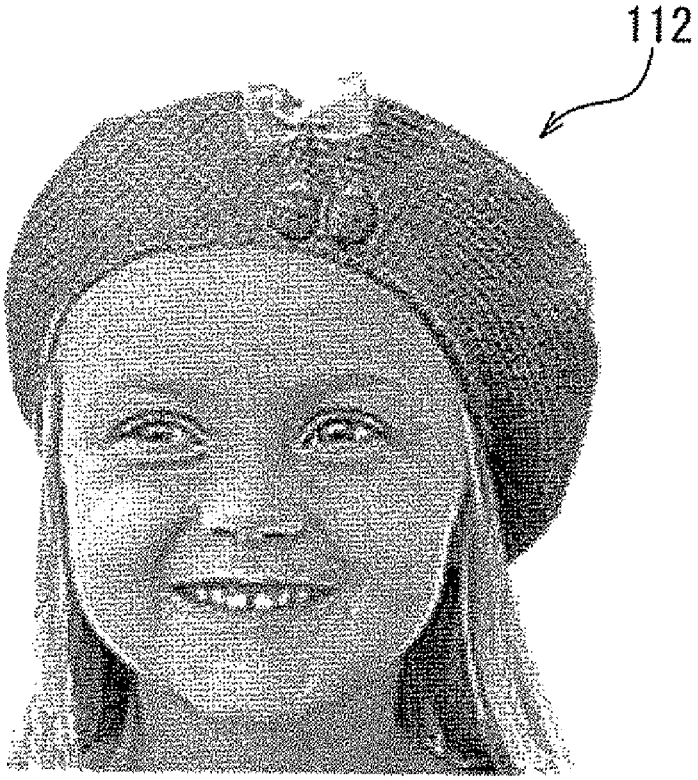
FIG. 5 is a figure that shows a second image 112.

Image data that are acquired through the image scanner 25 are stored in the second storage area 152 that is shown in FIG. 2. The embroidery data creation apparatus 1 can create the embroidery data for sewing an embroidery pattern that depicts the image that is stored in the second storage area 152. Hereinafter, an image that is stored in the second storage area 152 and is a basis of an embroidery pattern that is actually to be sewn is called a second image. For example, data for a second image 112 that is shown in FIG. 5 are stored in the second storage area 152. The embroidery data creation apparatus 1 can create embroidery data that make it possible to sew an embroidery pattern that depicts the second image 112.

A plurality of sewing conditions that can be implemented in the embroidery sewing machine 3 (refer to FIG. 6) are stored in the sewing conditions storage area 153. Information on colors of threads that are available in sewing (available thread colors) is at least included in the stored sewing conditions. The embroidery data that are created are stored in the embroidery data storage area 154. The embroidery data are created by the executing of the embroidery data creation program by the CPU 11. The embroidery data creation program that is executed by the CPU 11 is stored in the program storage area 155. In a case where the embroidery data creation apparatus 1 is not provided with the program storage area 155, the embroidery data creation program may be stored in the ROM 13. Initial values and set values for various types of parameters and the like, for example, are stored in the other data storage area 156.

Figure 6:
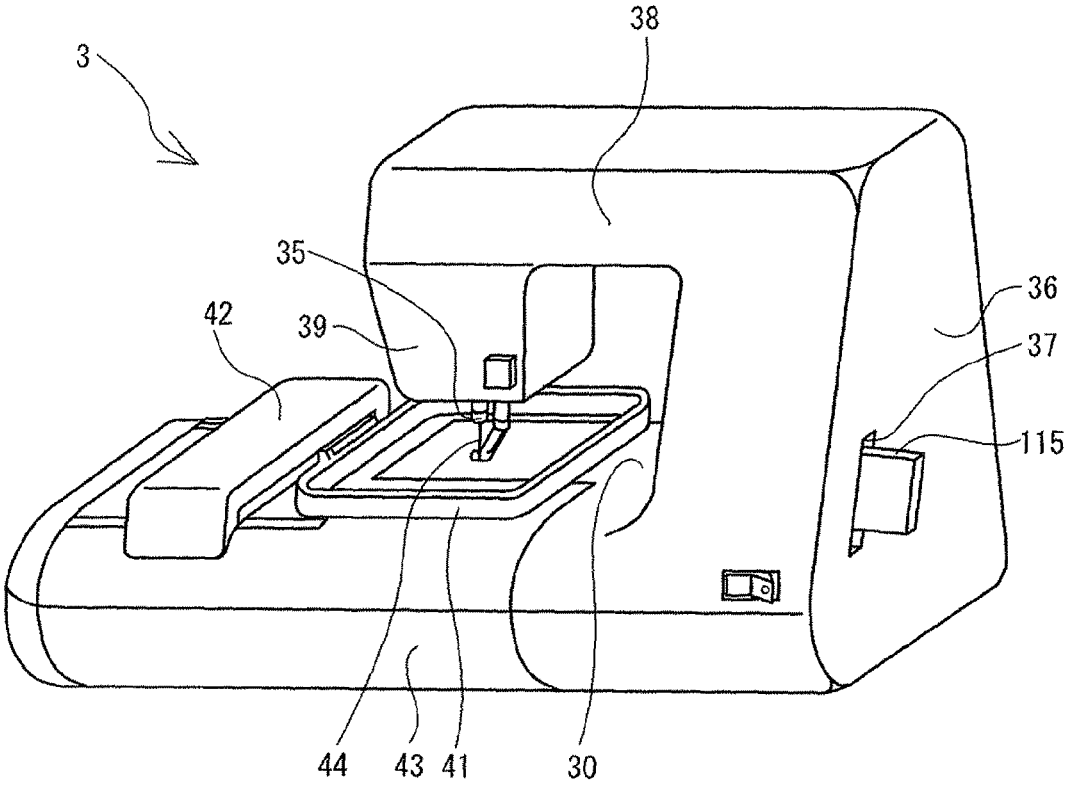
FIG. 6 is an external view of an embroidery sewing machine 3.

The embroidery sewing machine 3 that sews the embroidery pattern based on the embroidery data that are created by the embroidery data creation apparatus 1 will be explained briefly with reference to FIG. 6. As shown in FIG. 6, the embroidery sewing machine 3 has a bed 30, a pillar 36, an arm 38, and a head 39. The bed 30 extends in the left-right direction in relation to the operator. The pillar 36 rises vertically from the right end of the bed 30. The arm 38 extends to the left from the upper end of the pillar 36. The head 39 is connected to left end of the arm 38. An embroidery frame 41 that holds a work cloth (not shown in the drawings) on which an embroidery pattern is to be formed can be placed above the bed 30. A Y direction drive portion 42 and an X direction moving mechanism (not shown in the drawings) move the embroidery frame 41 to a specified position that is described in an XY coordinate system that is specific to the embroidery sewing machine 3. The X direction moving mechanism is contained within a main body case 43. The embroidery pattern can be formed on the work cloth by the operation of a needle bar 35 to which a sewing needle 44 is attached and the operation of a shuttle mechanism (not shown in the drawings), in conjunction with the moving of the embroidery frame 41. The Y direction drive portion 42, the X direction moving mechanism, the needle bar 35, and the like are controlled by a control device (not shown in the drawings) that includes a microcomputer or the like and that is built into the embroidery sewing machine 3.

A memory card slot 37 is provided on a side face of the pillar 36. The memory card 115 can be inserted into and removed from the memory card slot 37. For example, the embroidery data that are created by the embroidery data creation apparatus 1 may be stored in the memory card 115. The memory card 115 is inserted into the memory card slot 37. The embroidery data that are stored in the memory card 115 are read and are stored in the embroidery sewing machine 3. Based on the embroidery data that have been supplied from the memory card 115, the control device of the embroidery sewing machine 3 (not shown in the drawings) automatically controls the embroidering operation of the elements that are described above. Thus the embroidery sewing machine 3 is able to sew the embroidery pattern based on the embroidery data that have been created by the embroidery data creation apparatus 1.

The processing by which the embroidery data creation apparatus 1 creates the embroidery data will be explained with reference to FIGS. 7 to 21. When the embroidery data creation program that is stored in the program storage area 155 of the HDD 15 in FIG. 2 is activated, the CPU 11 performs the main processing in FIG. 7 in accordance with the embroidery data creation program.

The user sets an image such as a photograph, an illustration, or the like in the image scanner 25 and performs an operation to start reading the image. The image that is read through the image scanner 25 is acquired as the second image (Step S11). The data for the acquired second image are stored in the second storage area 152. Note that the data for a plurality of second images may be stored in the second storage area 152 in advance. Then a second image that is selected by the user from among the plurality of second images may be acquired at Step S11. In order to make it easier for the user to select the second image, a list of the plurality of second images that can be selected may be displayed on the display 24.

Based on the data that are stored in the pattern table, the plurality of first patterns is displayed in list form on the display 24. One of the plurality of first patterns is selected by the user. The selected first pattern is acquired (Step S12). For example, the user may select a first pattern that, in terms of gender, age, race, and the like, is similar to the image that was read by the image scanner 25 at Step S11. Alternatively, one of the first images in the pattern table may be acquired by automatically searching the pattern table for a first image that is similar to the image of a human face that is included in the second image that was acquired at Step S11.

Figure 8:
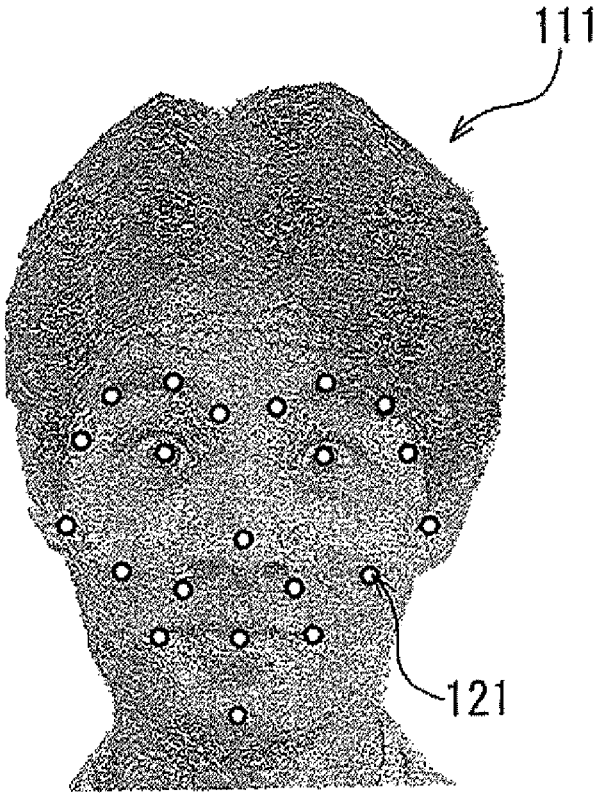
FIG. 8 is an explanatory figure of first characteristic points 121 that are designated in the first pattern 111.

The first pattern that is acquired at Step S12 is displayed on the display 24. On the displayed first pattern, the user designates a plurality of points (hereinafter called the first feature points) that prominently indicate features of the pattern. Data that indicate the positions of the plurality of designated first feature points are acquired (Step S13) and are stored in the RAM 12. For example, the first feature points may be designated in the positions of the eyebrows, the eyes, the nose, the cheeks, the mouth, and the chin in the first pattern. The first feature points may also be designated automatically based on a known algorithm. For example, an algorithm such as the Harris operator, the Scale Invariant Feature Transform (SIFT), or the like may be used as the known algorithm. As shown in FIG. 8, for example, first feature points 121 may be designated in the positions of the eyebrows, the eyes, the nose, the cheeks, the mouth, and the chin in the first pattern 111.

Alternatively, the first image that corresponds to the first pattern that was acquired at Step S12 may be selected from the pattern table and displayed on the display 24. The user may designate a plurality of the first feature points on the displayed first image.

Figure 9:
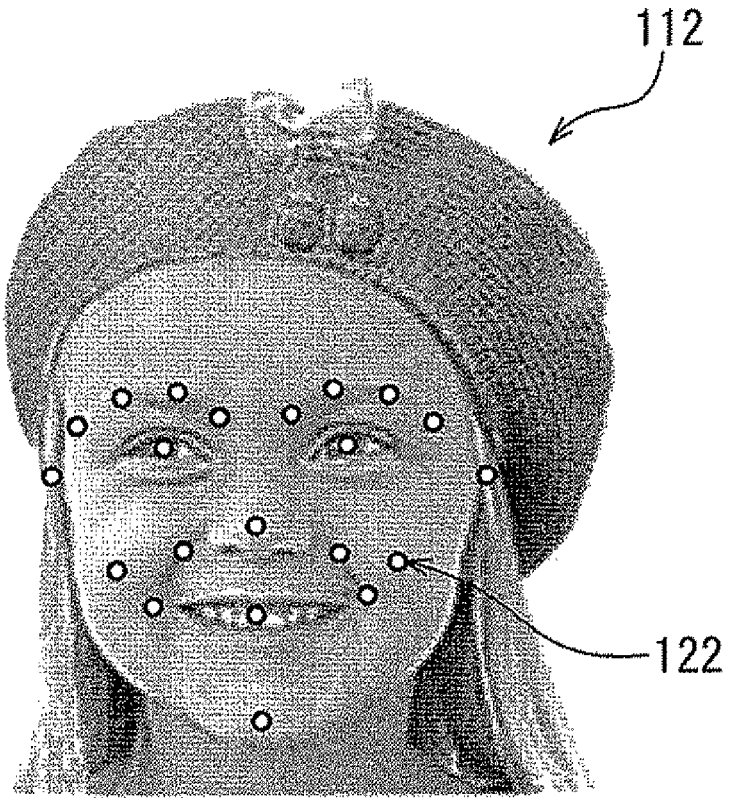
FIG. 9 is an explanatory figure of second characteristic points 122 that are designated in the second image 112.

The second image that was acquired at Step S11 is displayed on the display 24. On the displayed second image, the user designates a plurality of second feature points in positions that respectively correspond to positions of the plurality of first feature points that the user designated at Step S13. The second feature points are points that indicate features of the second image. Data that indicate the positions of the plurality of designated second feature points are acquired (Step S14). The acquired data are stored in the RAM 12 in association with the data that indicate the positions of the corresponding first feature points. For example, in a case where the first feature points have been designated in the positions of the eyebrows, the eyes, the nose, the cheeks, the mouth, and the chin in the first pattern, the corresponding second feature points are respectively designated in the positions of the eyebrows, the eyes, the nose, the cheeks, the mouth, and the chin in the second image. The second feature points may also be designated automatically based on a known algorithm (the Harris operator, the SIFT, or the like). The user may further make a final setting of the second feature points by correcting the second feature points that have been designated by the known algorithm. For example, as shown in FIG. 9, a plurality of second feature points 122 may be designated in positions in the second image 112 (the positions of the eyebrows, the eyes, the nose, the cheeks, the mouth, and the chin) that respectively correspond to the positions of the plurality of first feature points 121 (refer to FIG. 8).

Figure 7:
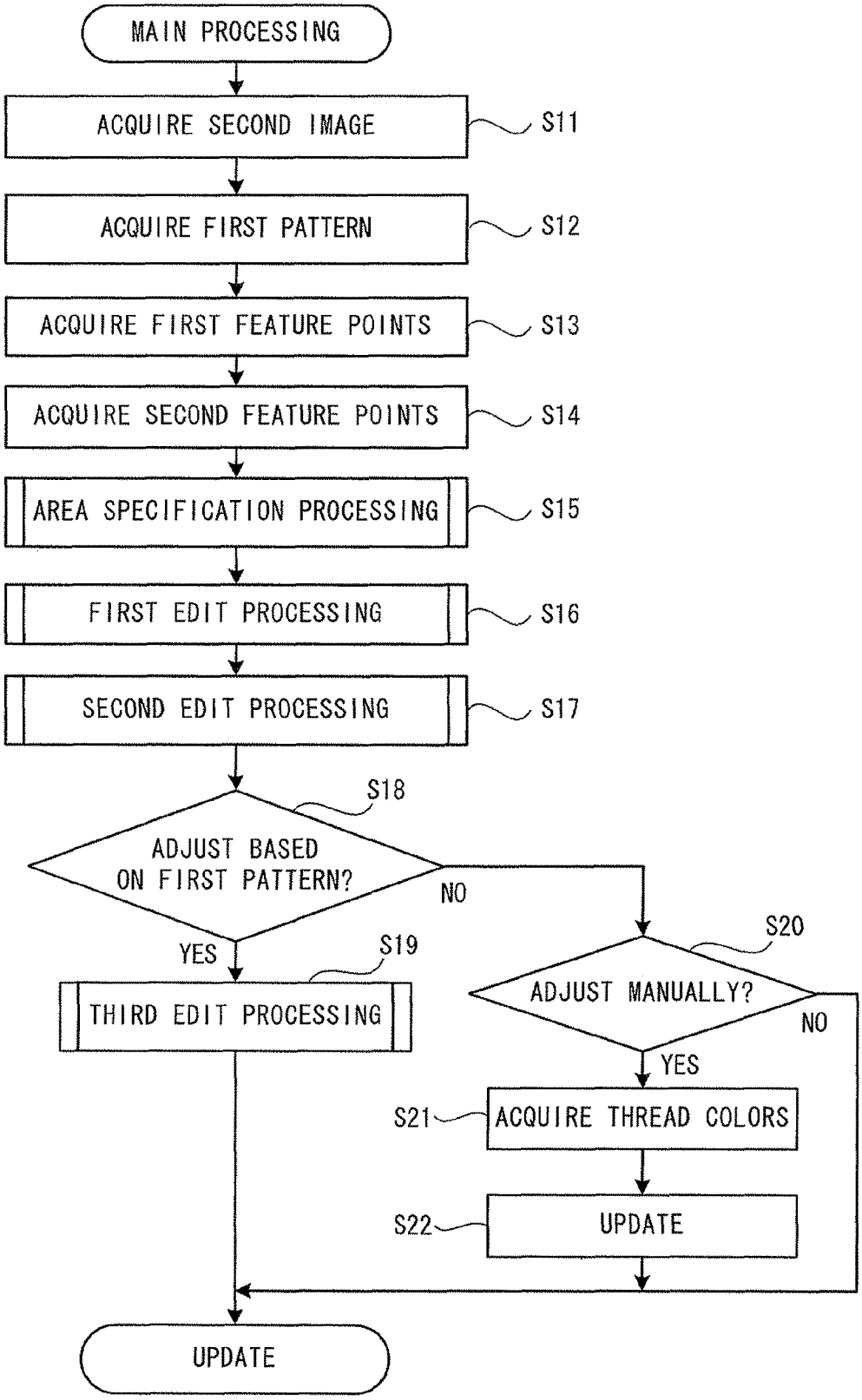
FIG. 7 is a flowchart of main processing.

As shown in FIG. 7, after the first feature points and the second feature points are acquired, area specification processing is performed (Step S15). The area specification processing will be explained with reference to FIG. 10. A plurality of line segments (hereinafter called the first point linking line segments) are designated, each of which links two of the plurality of first feature points that were designated at Step S13 (Step S31). The first point linking line segments may be designated based on the following method, for example. First, Voronoi cells are specified based on the plurality of first feature points. Next, Delaunay boundaries are specified based on the specified Voronoi cells. The first point linking line segments are positioned on the Delaunay boundaries. The first point linking line segments are positioned such that they form triangles for which three of the first feature points serve as the vertices. A plurality of triangular areas (hereinafter called the first partitioned areas) are specified, each of which is bounded by three of the first point linking line segments (Step S33). The three first feature points that are positioned at the vertices of each of the first partitioned areas are associated with one another. The mutually associated three first feature points are equivalent to a set of information (hereinafter called the first area information set) for specifying the corresponding first partitioned area. Data that indicate the positions of the first feature points that are included in the respective first area information sets are stored in the RAM 12.

Figure 11:
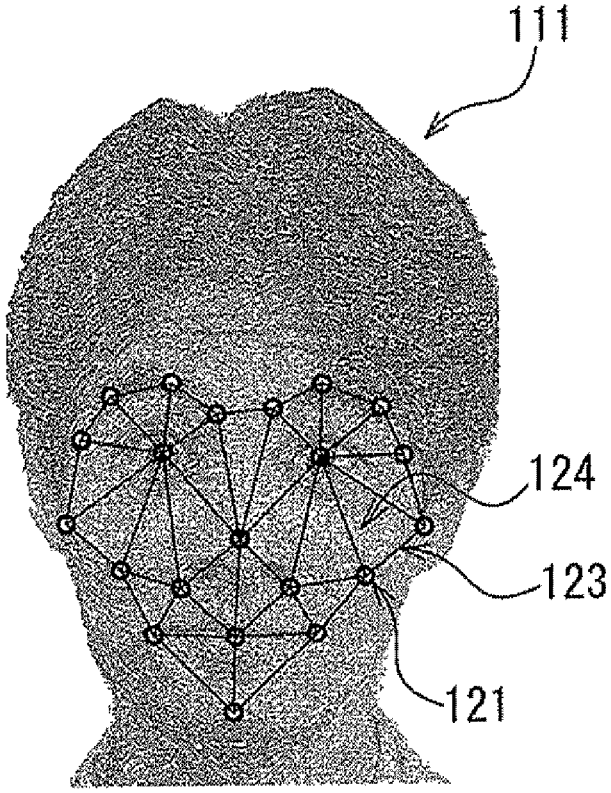
FIG. 11 is an explanatory figure of first partitioned areas 124 that are designated in the first pattern 111.

For example, as shown in FIG. 11, a plurality of first point linking line segments 123 are designated, each of which links two of the plurality of first feature points 121 that have been designated in the first pattern 111. A plurality of first partitioned areas 124 are specified, each of which is bounded by three of the first point linking line segments 123. Each of the first area information sets that specifies each of the first partitioned areas 124 includes data that indicate the positions of the three of the first feature points 121 that are positioned at the vertices of the corresponding first partitioned area 124.

Figure 10:
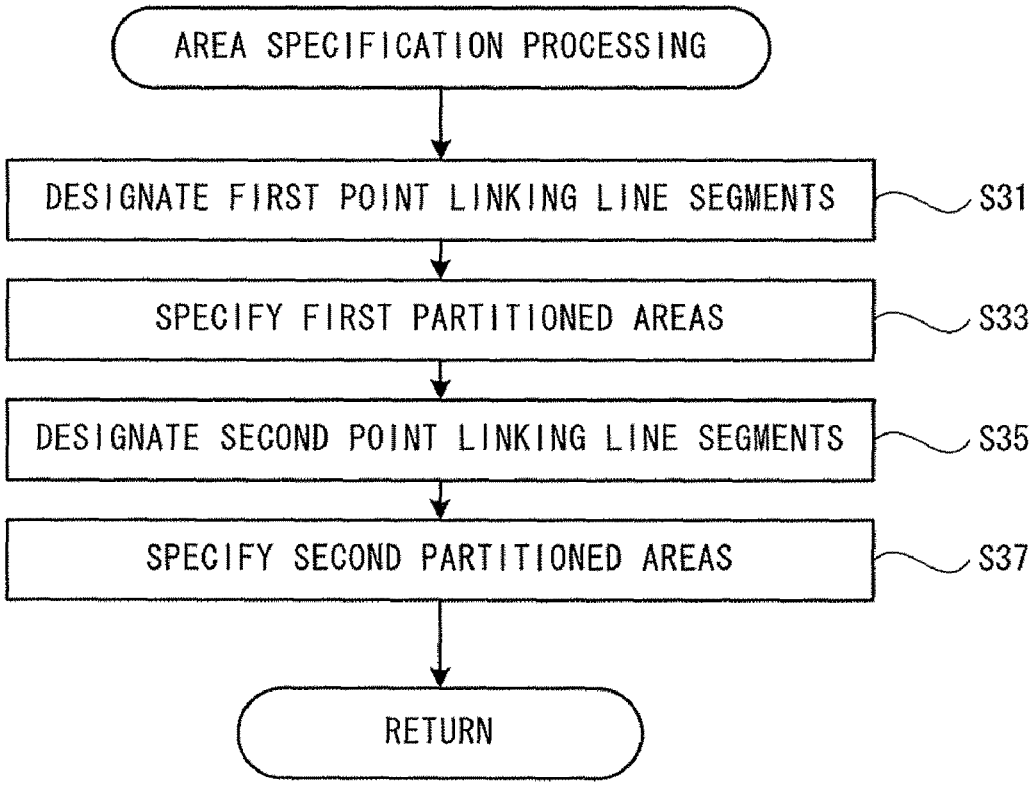
FIG. 10 is a flowchart of area specification processing that is performed in the main processing.

As shown in FIG. 10, a plurality of line segments (hereinafter called the second point linking line segments) are designated, each of which links two of the plurality of second feature points that were designated at Step S14 (refer to FIG. 7) (Step S35). The second point linking line segments may be designated by the same method that was used to designate the first point linking line segments. A plurality of triangular areas (hereinafter called the second partitioned areas) are specified, each of which is bounded by three of the second point linking line segments (Step S33). The three second feature points that are positioned at the vertices of each of the second partitioned areas are associated with one another. The mutually associated three second feature points are equivalent to a set of information (hereinafter called the second area information set) for specifying the corresponding second partitioned area. Data that indicate the positions of the second feature points that are included in the respective second area information sets are stored in the RAM 12. The area specification processing is then terminated, and the processing returns to the main processing (refer to FIG. 7).

Figure 12:
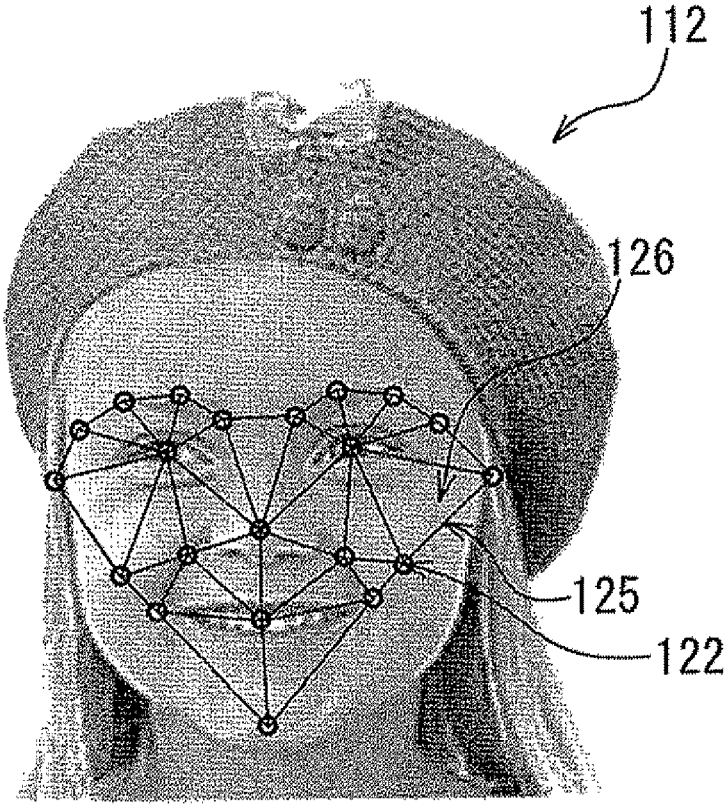
FIG. 12 is an explanatory figure of second partitioned areas 126 that are designated in the second image 112.

For example, as shown in FIG. 12, a plurality of second point linking line segments 125 are designated, each of which links two of the plurality of second feature points 122 that have been designated in the second image 112. A plurality of second partitioned areas 126 are specified, each of which is bounded by three of the second point linking line segments 125. Each of the second area information sets that specifies each of the second partitioned areas 126 includes data that indicate the positions of the three of the second feature points 122 that are positioned at the vertices of the corresponding second partitioned area 126.

As shown in FIG. 7, in the main processing, after the area specification processing (Step S15), first edit processing is performed (Step S16). In the first edit processing, the information that indicates the positions of the needle drop points, which are included in the pattern information that is stored in the pattern table, is converted based on the specified first partitioned areas and second partitioned areas.

The first edit processing will be explained with reference to FIG. 13. One of the plurality of first area information sets is acquired from the RAM 12 (Step S41). One of the second area information sets that corresponds to the acquired first area information set is specified based on the correspondence relationships between the first feature points and the second feature points. The specified second area information set is acquired from the RAM 12 (Step S43).

The information that indicates the positions of the needle drop points that correspond to the first pattern that was acquired at Step S12 (refer to FIG. 7) is selected from the pattern table. A plurality of the needle drop points that are located within the first partitioned area that is specified by the first area information set that was acquired at Step S41 are selected from among the needle drop points that are indicated by the selected information (Step S45).

A line segment (hereinafter called the sewing line segment) is specified that links, from among the needle drop points that were selected at Step S45, two needle drop points that are to be used in succession in sewing (hereinafter called the two successive needle drop points). The determination of the two successive needle drop points can be made based on the information on the sewing sequence that is included in the pattern information in the pattern table. A determination is made as to whether the specified sewing line segment intersects any one of the first point linking line segments that link the first feature points (Step S63). In a case where the sewing line segment does intersect one of the first point linking line segments (YES at Step S63), a new needle drop point is set at the point of intersection. The new needle drop point is added to the needle drop points that were selected at Step S45, between the needle drop points positioned at the ends of the sewing line segment (Step S65). This ensures that the thread that is sewn will be firmly fixed to the cloth at the position of the intersection point. The processing then proceeds to Step S47. In a case where the sewing line segment intersects none of the first point linking line segments (NO at Step S63), the processing proceeds directly to Step S47.

Figure 14:
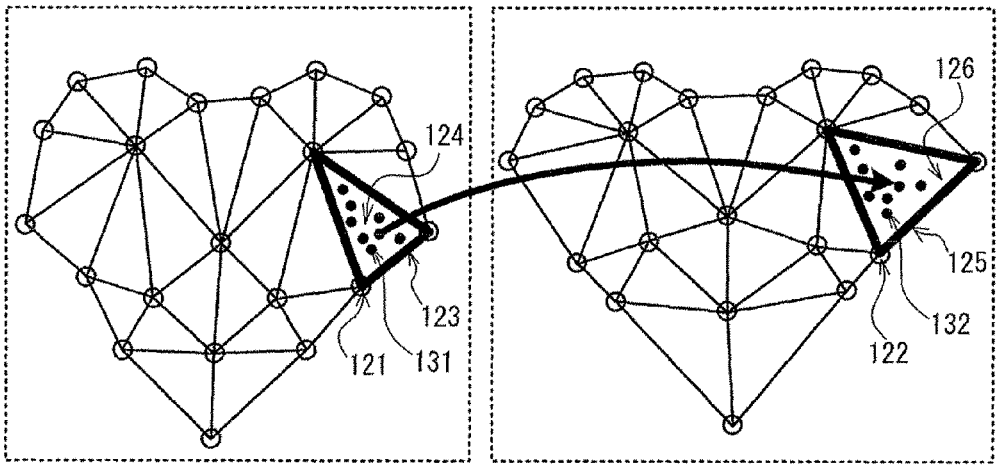
FIG. 14 is an explanatory figure that shows a correspondence relationship between one of the first partitioned areas 124 and one of the second partitioned areas 126.

The information that indicates the positions of the needle drop points that were selected at Step S45 is converted based on the positional relationships between the three first feature points that are included in the first area information set that was acquired at Step S41 and the three second feature points that correspond to the first feature points (Step S47). The post-conversion needle drop points are equivalent to the needle drop points that are located within the second partitioned area that is specified by the second area information set. For example, as shown in FIG. 14, based on the positional relationships between the three first feature points 121 that are at the vertices of the first partitioned area 124 and the three second feature points 122 that are at the vertices of the corresponding second partitioned area 126, needle drop points 131 that are located within the first partitioned area 124 are converted to needle drop points 132 that are located within the second partitioned area 126.

Figure 15:
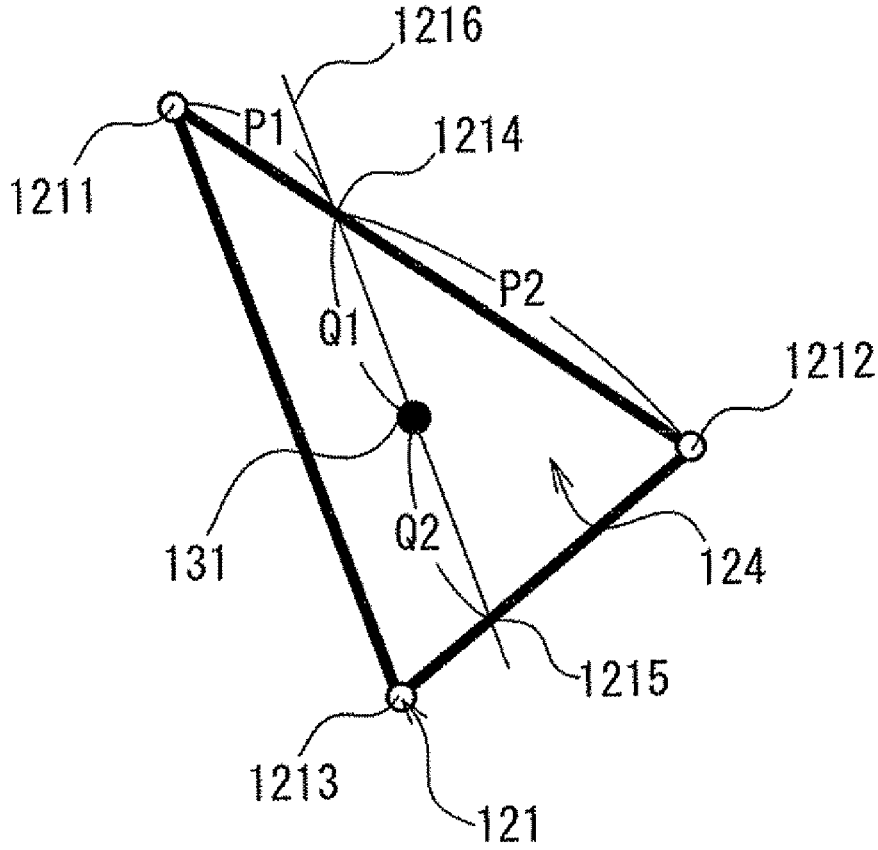
FIG. 15 is an explanatory figure of the one of the first partitioned areas 124.

The method for converting the positions of the needle drop points will be explained using a concrete example. Refer to the first partitioned area 124 that is shown in FIG. 15. The first feature points 1211, 1212, 1213 are located at the vertices of the first partitioned area 124. A straight line 1216 is defined in the first partitioned area 124. The straight line 1216 is parallel to the first point linking line segment that links the first feature point 1211 and the first feature point 1213, and it is a straight line that satisfies the condition that it passes through the needle drop point 131. An intersection point 1214 is specified as the point of intersection between the straight line 1216 and the first point linking line segment that links the first feature point 1211 and the first feature point 1212. An intersection point 1215 is specified as the point of intersection between the straight line 1216 and the first point linking line segment that links the first feature point 1212 and the first feature point 1213. A ratio P1:P2 is specified as the ratio of the distance between the first feature point 1211 and the intersection point 1214 to the distance between the first feature point 1212 and the intersection point 1214. A ratio Q1:Q2 is specified as the ratio of the distance between the needle drop point 131 and the intersection point 1214 to the distance between the needle drop point 131 and the intersection point 1215. The specified ratios are stored in the RAM 12.

Figure 16:
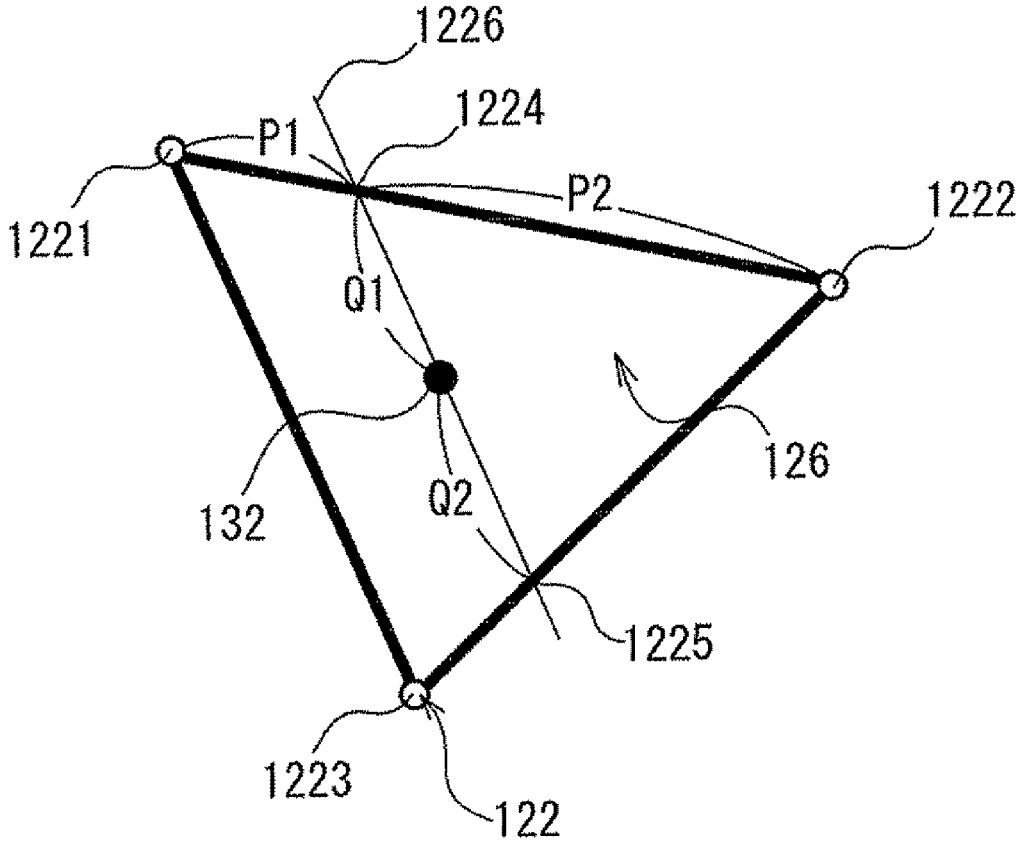
FIG. 16 is an explanatory figure of the one of the second partitioned areas 126.

Refer to the corresponding second partitioned area 126 that is shown in FIG. 16. The second feature points 1221, 1222, 1223 are located at the vertices of the second partitioned area 126. First, a point 1224 is defined that divides the second point linking line segment that links the second feature point 1221 and the second feature point 1222. The point 1224 is a point that satisfies the condition that the ratio of the distance between the second feature point 1221 and the point 1224 to the distance between the second feature point 1222 and the point 1224 is equal to the ratio P1:P2. Next, a straight line 1226 is defined. The straight line 1226 is parallel to the second point linking line segment that links the second feature point 1221 and the second feature point 1223, and it is a straight line that satisfies the condition that it passes through the point 1224. Next, an intersection point 1225 is defined. The intersection point 1225 is the point of intersection between the straight line 1226 and the second point linking line segment that links the second feature point 1222 and the second feature point 1223. Next, a point 132 is defined that divides the straight line 1226. The point 132 satisfies the condition that the ratio of the distance between the point 1224 and the point 132 to the distance between the intersection point 1225 and the point 132 is equal to the ratio Q1:Q2. In this manner, the position of the needle drop point 131 within the first partitioned area 124 (refer to FIG. 15) is converted to the position of the point 132. The point 132 is equivalent to a post-conversion needle drop point.

Figure 13:
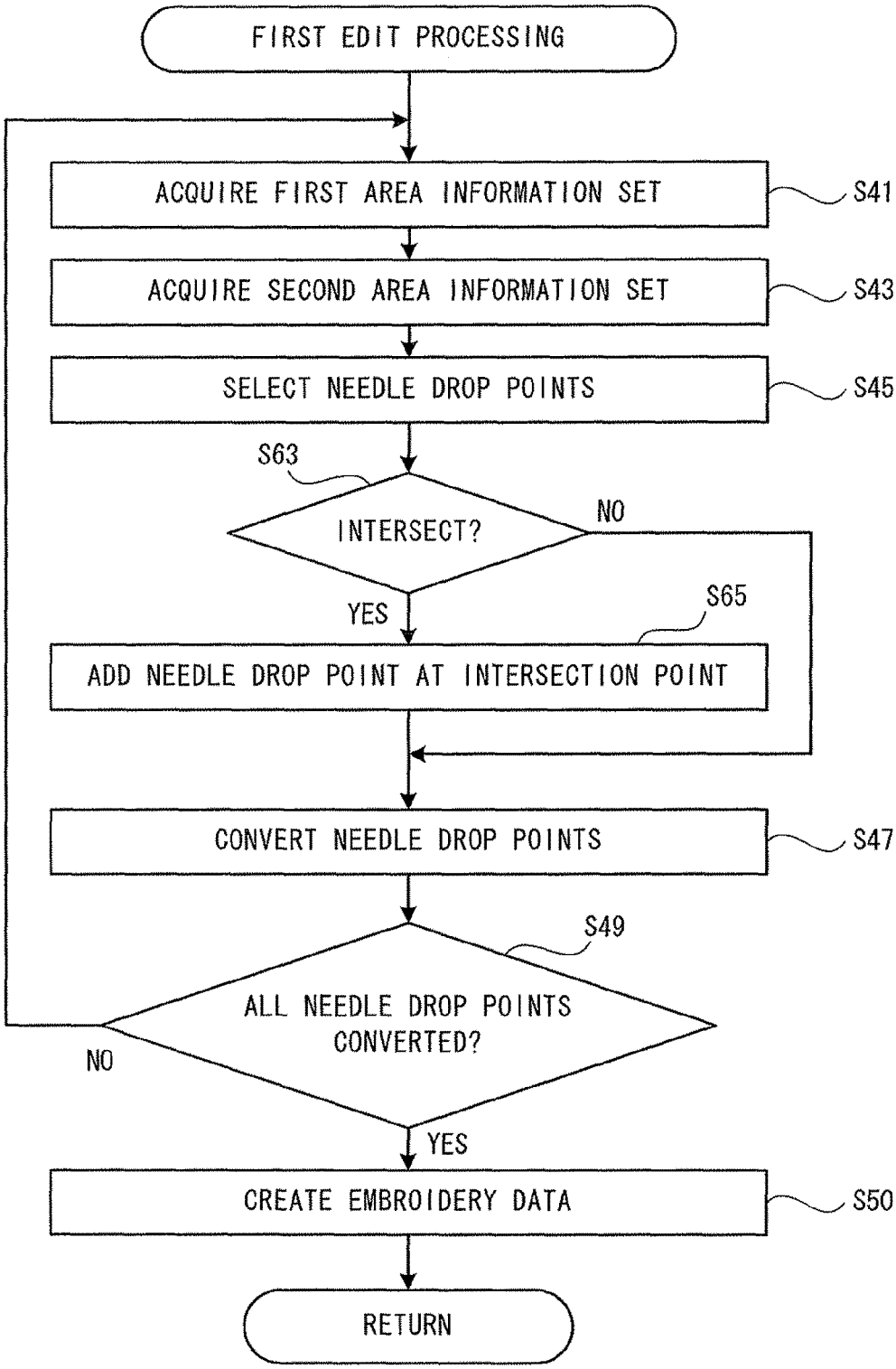
FIG. 13 is a flowchart of first edit processing that is performed in the main processing.

As shown in FIG. 13, the processing that is described above is performed for all of the needle drop points that were selected at Step S45 and for the needle drop point that was added at Step S65 (Step S47). The information that indicates the positions of the post-conversion needle drop points is stored in the RAM 12 as the information that indicates the positions of needle drop points within the second partitioned area. A determination is made as to whether all of the first partitioned areas have been acquired and whether the information that indicates the positions of all of the needle drop points has been converted (Step S49). In a ease where an unacquired first partitioned area remains, that is, where an unconverted needle drop point remains (NO at Step S49), the processing returns to Step S41.

In a case where all of the first partitioned areas have been acquired and the information that indicates the positions of all of the needle drop points has been converted (YES at Step S49), the information for the sewing sequence and the information for the thread colors that correspond to the respective pre-conversion needle drop points is selected from the pattern table. The selected information is then associated with the information that indicates the positions of the post-conversion needle drop points. Note that in a case where the new needle drop point has been added at Step S65, the corresponding information for the sewing sequence is associated with the information that indicates the position of the post-conversion needle drop point, after the sewing sequence has been changed. Thus the embroidery data for sewing the embroidery pattern are created based on the second image (Step S50). The information that indicates the positions of the post-conversion needle drop points, as well as the information for the sewing sequence and the information for the thread colors, is stored as the embroidery data in the embroidery data storage area 154. The first edit processing is then terminated, and the processing returns to the main processing (refer to FIG. 7).

As shown in FIG. 7, in the main processing, after the first edit processing (Step S16), second edit processing (refer to FIG. 17) is performed (Step S17). In the second edit processing, addition and deletion of the needle drop points are performed as necessary.

Figure 17:
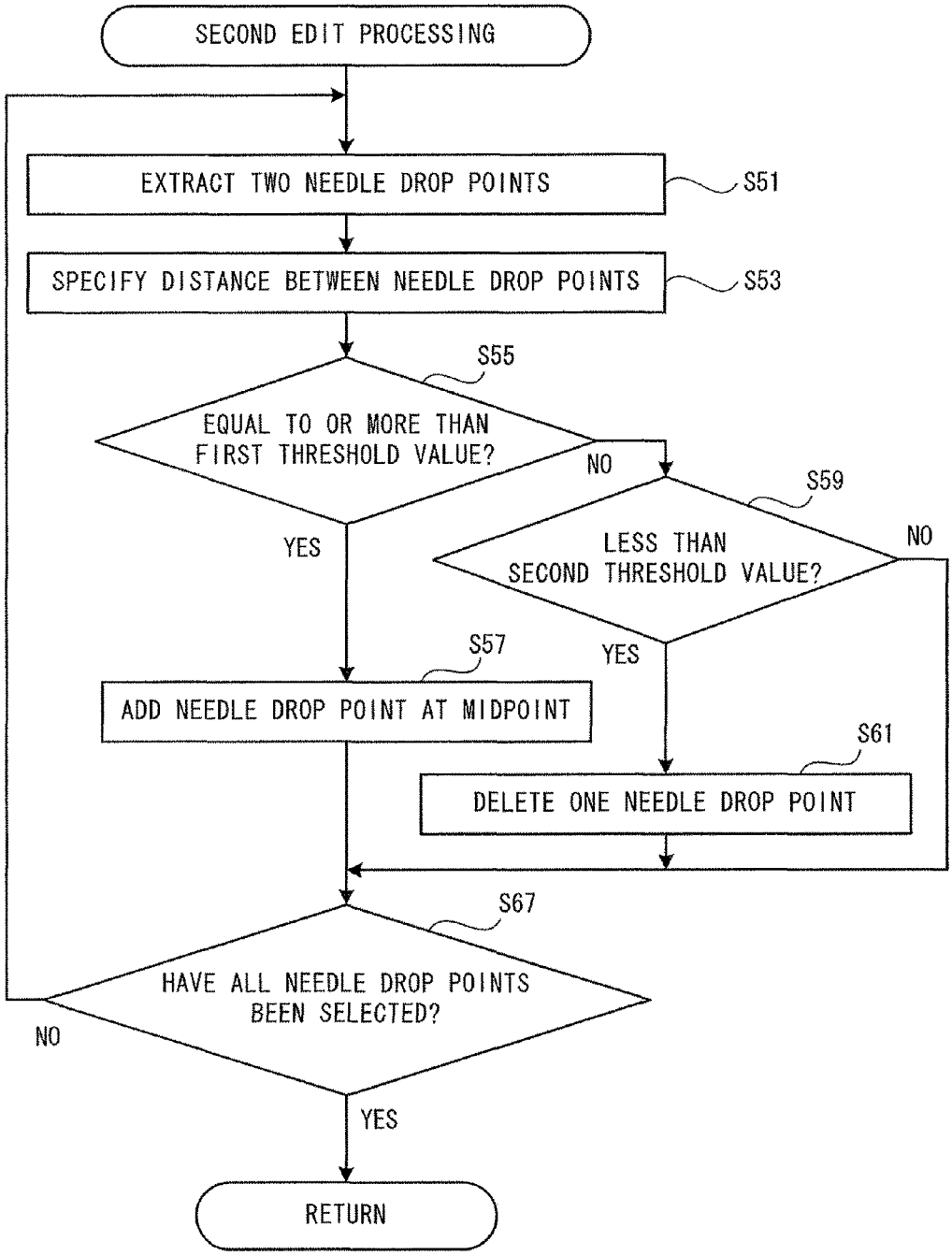
FIG. 17 is a flowchart of second edit processing that is performed in the main processing.

The second edit processing will be explained with reference to FIG. 17. Two successive needle drop points are selected from the embroidery data that are stored in the embroidery data storage area 154 (Step S51). The determination of the two successive needle drop points can be made based on the information on the sewing sequence that is included in the embroidery data. The distance between the two selected successive needle drop points is specified (Step S53). A determination is made as to whether the specified distance is equal to or more than a first threshold value (for example, 7 millimeters) (Step S55). In a case where the specified distance between the two selected needle drop points is equal to or more than the first threshold value (YES at Step S55), a new needle drop point is established in a position at the midpoint of a line segment that links the two selected successive needle drop points. Information that indicates the position of the newly established needle drop point is added to the embroidery data that are stored in the embroidery data storage area 154 (Step S57). The information in the embroidery data that indicates the sewing sequence is also changed in accordance with the addition of the new needle drop point. This processing makes it possible to prevent the distance between the needle drop points from becoming too long and making the sewn thread unstable. The processing then proceeds to Step S67.

The position of the needle drop point that is added at Step S57 is not limited to being the midpoint, as long as it is between the two needle drop points. The number of the needle drop points that are added may also be other than one. A plurality of needle drop points may also be designated such that the distances between adjacent needle drop points are less than the first threshold value.

In a case where the distance between the two selected successive needle drop points is less than the first threshold value (NO at Step S55), a determination is made as to whether the distance between the two needle drop points is less than a second threshold value (for example, 0.5 millimeters) (Step S59). In a case where the distance between the two needle drop points is less than the second threshold value (YES at Step S59), one of the two needle drop points is selected. The information that indicates the position of the selected needle drop point is deleted from the embroidery data that are stored in the embroidery data storage area 154 (Step S61). The information in the embroidery data that indicates the sewing sequence is also changed in accordance with the deletion of the needle drop point. This processing makes it possible to reduce the number of unnecessary needle drop points while maintaining the quality of the embroidery pattern. The processing then proceeds to Step S67. In a case where the distance between the two needle drop points is not less than the second threshold value (NO at Step S59), the processing proceeds directly to Step S67.

A determination is made as to whether all of the needle drop points have been selected at Step S51 (Step S67). In a case where not all of the needle drop points have been selected (NO at Step S67), the processing returns to Step S51. In a case where all of the needle drop points have been selected (YES at Step S67), the second edit processing is terminated, and the processing returns to the main processing (refer to FIG. 7).

As shown in FIG. 7, in the main processing, after the second edit processing (Step S17), processing is performed that adjusts the thread colors that are included in the embroidery data (Steps S18 to S22). A method for adjusting the thread colors is selected by the user. In the present embodiment, the user is able to select one of three methods. The first is a method that adjusts the thread colors based on the information on the thread colors for the first pattern, the second is a method that adjusts the thread colors manually, and the third is a method that uses the information on the thread colors for the first pattern in its existing form. In a case where the user has selected the method that adjusts the thread colors based on the thread color information for the first pattern (YES at Step S18), third edit processing is performed (Step S19).

The third edit processing will be explained with reference to FIG. 18. The information on the colors of the threads to be used for sewing the first pattern is selected from the pattern table. The amount of thread that is to be used is specified for each of the thread colors. The ratio of the amount of thread that is to be used for each color is computed in relation to the total amount of threads that are to be used for sewing the first pattern (Step S73). The computed ratios are called the first ratios. For example, in FIG. 19, the thread colors (K, L, M) that are to be used for sewing the first pattern and the first ratios for the respective colors (25%, 44%, 31%) are shown in the form of a histogram. The colors on the horizontal axis are arranged in an order that is based on parameters (for example, hue, saturation, brightness) that characterize the colors.

Figure 18:
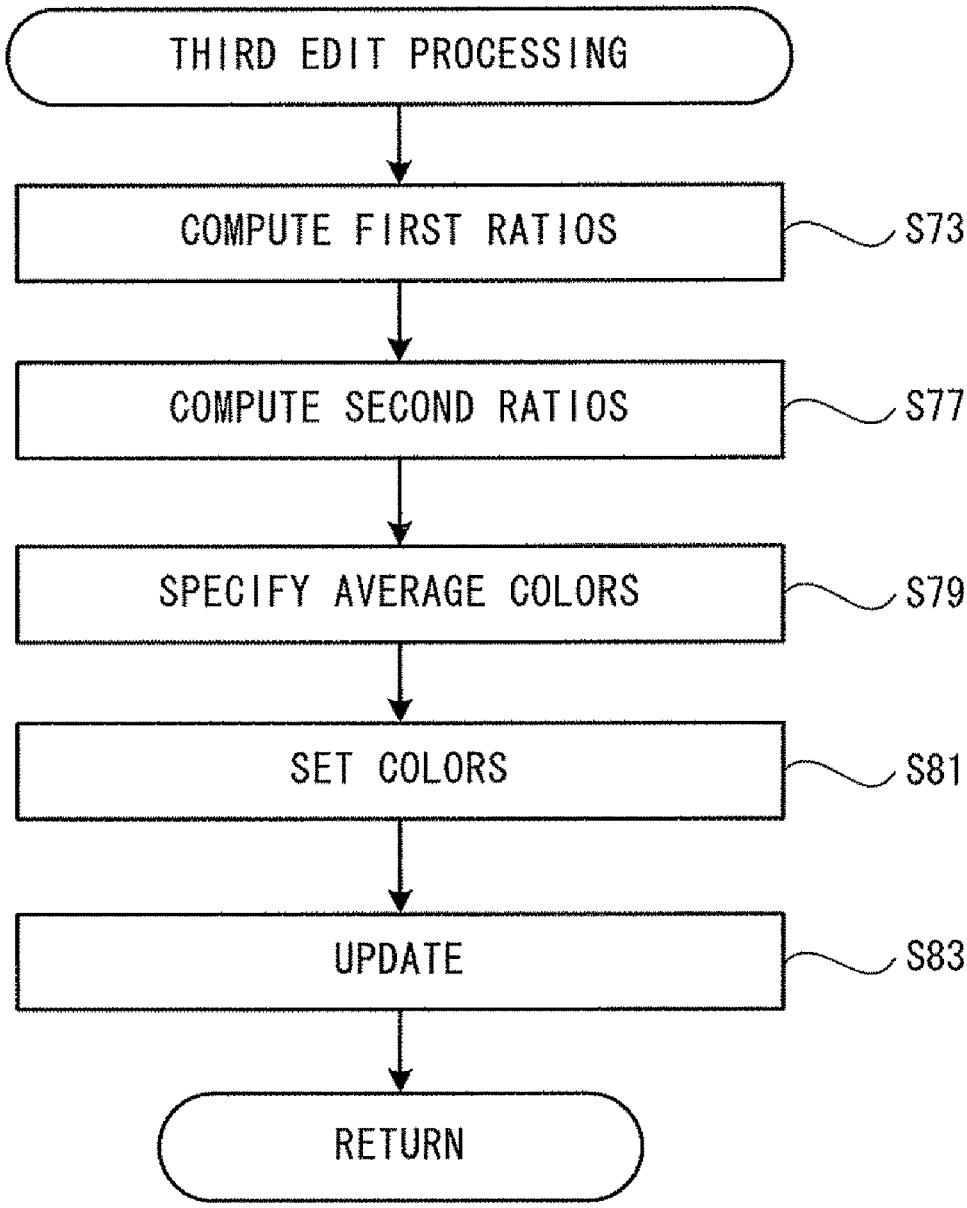
FIG. 18 is a flowchart of third edit processing that is performed in the main processing.
Figure 19:
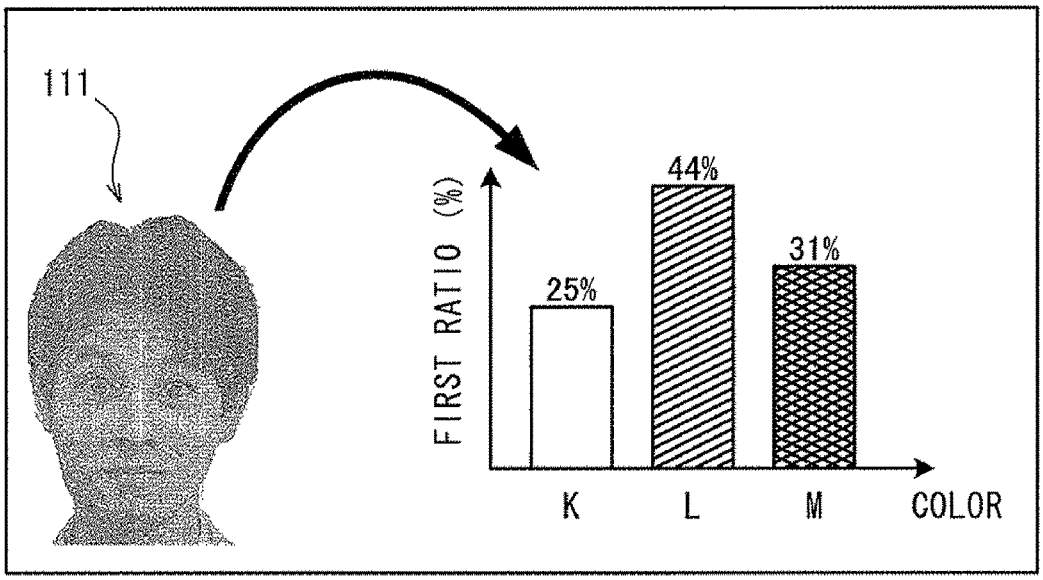
FIG. 19 is a graph that shows first ratios.
Figure 20:
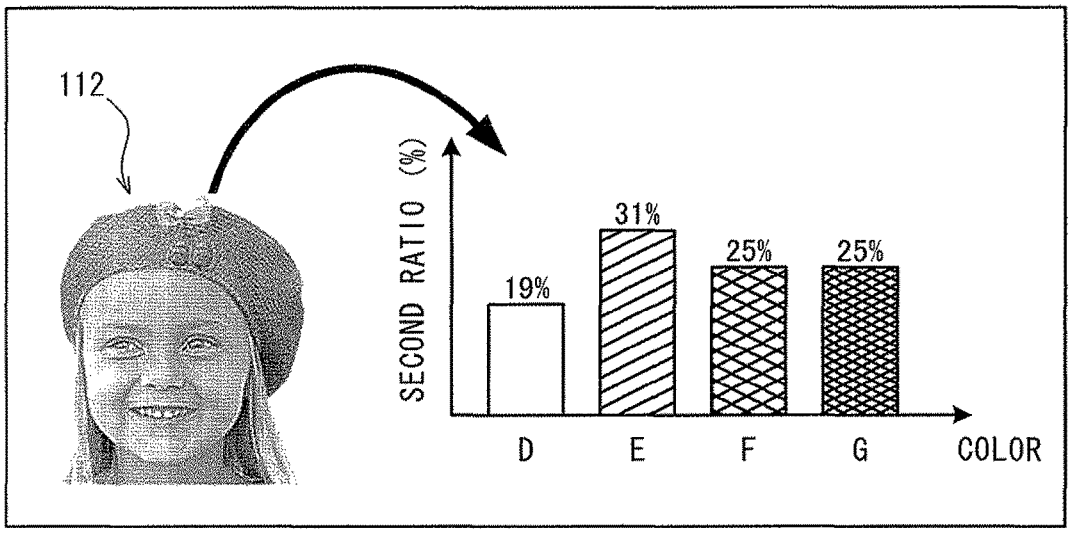
FIG. 20 is a graph that shows second ratios.

As shown in FIG. 18, the ratio of the surface area of each color is computed in relation to the surface area of the entire second image (Step S77). The computed ratios are called the second ratios. The color distribution in the second image is specified by the second ratios. For example, in FIG. 20, the colors (D, E, F, G) that make up the second image and the second ratios for the respective colors (19%, 31%, 25%, 25%) are shown in the form of a histogram. The colors on the horizontal axis are arranged in an order that is based on the same parameters as in FIG. 19. Note that the colors in the second image are defined as being the four colors noted above in order to simplify the explanation.

Figure 21:
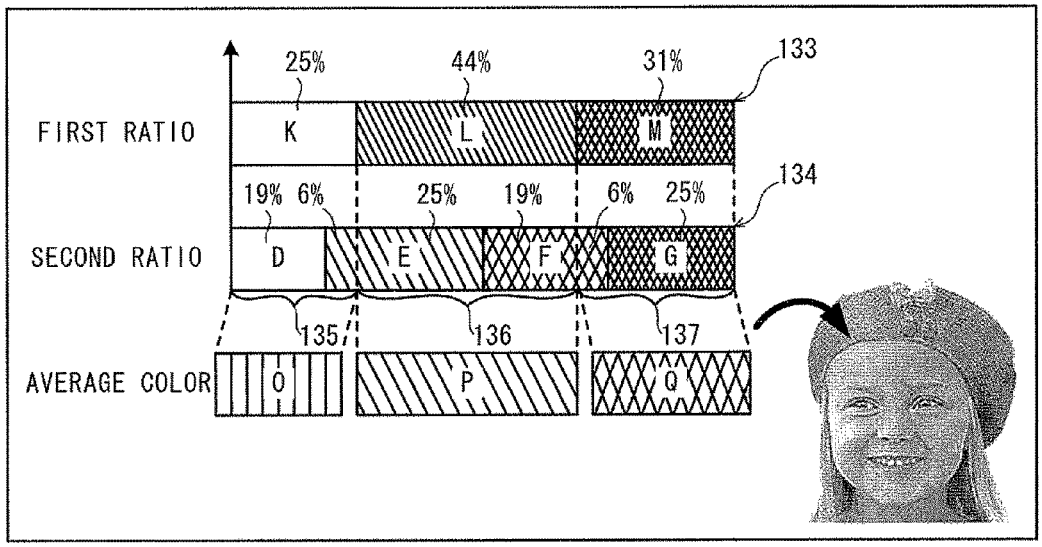
FIG. 21 is an explanatory figure of a method for setting a thread color based on the first ratios and the second ratios.

As shown in FIG. 18, the colors of the threads that are to be used for sewing an embroidery pattern (hereinafter called the second pattern) that corresponds to the second image are specified based on the first ratios and the second ratios that have been computed (Steps S79, S81). The method for specifying the thread colors will be explained using a concrete example. As shown in FIG. 21, the first ratios and the second ratios are respectively lined up and accumulated in order based on the specified parameters (hue, saturation, brightness). The accumulated second ratios (25%, 44%, 31%) are divided into a plurality of blocks in accordance with the first ratios (135, 136, 137). The second ratios are thus redistributed. An average color is specified for each of the separate blocks. For example, the block 135, which corresponds to the thread color K, includes the color D at a 19% ratio and the color E at a 6% ratio. Therefore, the average color for this block is specified as a color that is determined by multiplying each of the parameters (hue, saturation, brightness) that characterize each of the colors times the corresponding ratios for the colors, adding up the results, and then computing the average value. This process is performed in the same manner for the block 136 and the block 137. The average colors (O, P, Q) are thus specified (refer to FIG. 18, Step S79).

As shown in FIG. 18, the colors of the threads that are to be used for sewing the second pattern are set based on the specified average colors. The information on the thread colors that are available for sewing are read from the sewing conditions storage area 153. The colors that most closely approximate the specified average colors are selected from among the available colors. The selected colors are set as the colors of the threads that are to be used for sewing (Step S81). The information for the thread colors in the embroidery data that are stored in the embroidery data storage area 154 are updated in accordance with the information of the colors of the threads that have been set (Step S83). When the embroidery pattern is sewn based on the embroidery data that have been created in this manner, the color tone of the embroidery pattern that is sewn (the second pattern) will be similar to that of the first pattern. After the embroidery data have been updated (Step S83), the third edit processing is terminated, the processing returns to the main processing (refer to FIG. 7), and the main processing is terminated.

The method for setting the colors of the threads that are to be used for sewing the second pattern is not limited to the method described above. For example, information about a range of colors that can be set may be stored in the sewing conditions storage area 153, and the colors of the threads that are to be used for sewing the second pattern may be set based on the stored information. For example, in a case where the average color is outside the range of colors that can be set, a color that is the closest to the average color among the colors within the range that can be set may be set as the color of the thread that is to be used for sewing.

As shown in FIG. 7, in a case where the user has selected the method that adjusts the thread colors manually (NO at Step S18; YES at Step S20), the user inputs the thread color that is to be used for sewing each of the portions of the pattern to be sewn. The information for the thread colors that the user has input are acquired (Step S21). The information for the thread colors in the embroidery data that are stored in the embroidery data storage area 154 is updated in accordance with the information for the thread colors that was acquired at Step S21 (Step S22). The main processing is then terminated.

Note that in a case where the thread colors are input manually, the colors that the user can input may be limited. For example, the thread color that is used for sewing a portion that depicts human skin may be input by selecting one of a limited set of colors (white, yellow, black, and the like).

In a case where the user has selected the method that uses the information on the colors of the threads for the first pattern in its existing form (NO at Step S20), the main processing is immediately terminated. The information on the thread colors in the embroidery data that are stored in the embroidery data storage area 154 match the information on the thread colors that are stored in the pattern table. When the sewing is performed based on the embroidery data, the color tone of the embroidery pattern that is embroidered will match that of the first pattern.

After the main processing has been performed, the embroidery data that are stored in the embroidery data storage area 154 are stored in the memory card 115 (refer to FIG. 2) in accordance with a command from the user. The memory card 115 is then inserted into the memory card slot 37 (refer to FIG. 6) of the embroidery sewing machine 3 (refer to FIG. 6). The embroidery sewing machine 3 reads the embroidery data that are stored in the memory card 115. The embroidery sewing machine 3 is able to sew the embroidery pattern based on the embroidery data that has been read.

As explained previously, based on the pattern information for the first pattern, which is a model embroidery pattern, the embroidery data creation apparatus 1 according to the first embodiment creates the embroidery data for sewing the embroidery pattern that is based on the second image. Accordingly, the embroidery data creation apparatus 1 is able to take the features of the first pattern that are represented by the pattern information for the first pattern and reflect them in the embroidery pattern that is to be sewn. Therefore, the embroidery data creation apparatus 1 is able to create embroidery data from which an embroidery pattern can be sewn that has a good finished quality that approximates the model pattern.

Of the pattern information, the information that indicates the positions of the needle drop points is grouped according to each of the first partitioned areas and converted, such that information is created that indicates the positions of the corresponding needle drop points in the second partitioned areas. Therefore, the embroidery pattern that is sewn based on the embroidery data has a good finished quality in which the distribution of the needle drop points in the first pattern is accurately reproduced.

The embroidery data creation apparatus 1 can also add a needle drop point as necessary. It is therefore possible to prevent the distance between the two needle drop points from becoming too long and making the sewn thread unstable. Furthermore, the thread that is sewn can be firmly fixed to the cloth at the position of the intersection point of the sewing line segment and the first point linking line segment, The embroidery data creation apparatus 1 can also delete a needle drop point as necessary. In a case where the distance between two needle drop points is extremely short, the quality and the strength of the embroidery pattern will not be changed even if one of the needle drop points is deleted. Therefore, the embroidery data creation apparatus 1 is able to reduce the number of unnecessary needle drop points while maintaining the quality of the embroidery pattern.

Various types of modifications can be made to the first embodiment. For example, the first feature points that are designated for the first pattern may be designated uniformly over the entire first pattern. On the contrary, the first feature points may be designated only for some portions of the first pattern (the eyes, the nose, the mouth, the hair, the shape of the face, and the like) where the user wants to make the finished quality of the embroidery pattern particularly good.

In the first embodiment, the information for the colors of the threads that are to be used for sewing the entire second pattern are set based on the tone of colors of the threads that are to be used for sewing the entire first pattern and on the tone of the colors in the entire second image. Alternatively, the thread colors may be set for each of the patterns that are contained within the corresponding second partitioned areas. Further, the user may be allowed to set the areas for which the thread colors can be specified. The thread colors can thus be adjusted for each of the elements of the face (the eyes, the nose, the mouth, the hair, and the like). Then the embroidery data creation apparatus 1 is able to create embroidery data from which an embroidery pattern can be sewn that has a natural finished quality.

In the first embodiment, embroidery patterns that depict images that show human faces are defined as the first patterns. In this case, a plurality of faces that shows different facets in terms of points such as gender, age, race, hairstyle, the presence or absence of glasses or hats, and the like may be prepared. The faces may be in a state of facing the front and may also be in a state of facing obliquely. The first patterns may also be embroidery patterns that depict images that show animal faces, for example.

Second Embodiment

Figure 22:
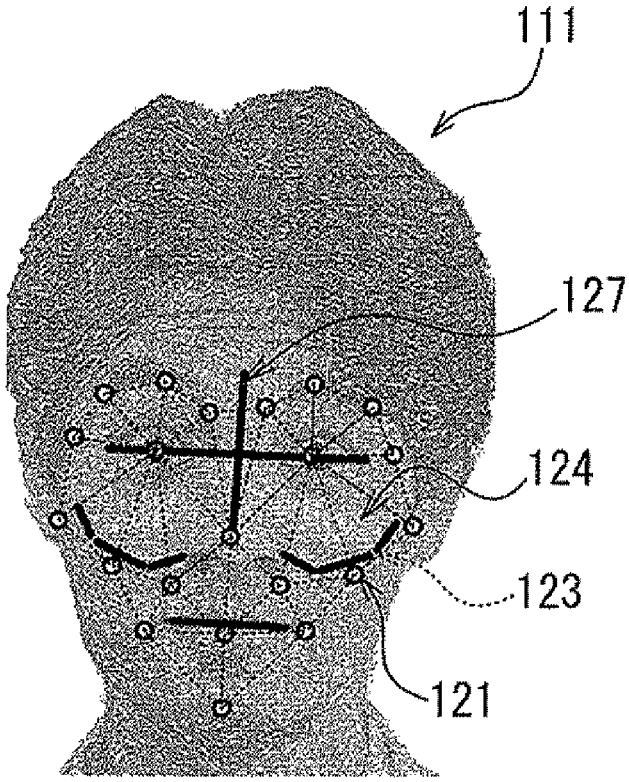
FIG. 22 is an explanatory figure that shows feature line segments 127 that are designated in the first pattern 111.

A second embodiment will be explained with reference to FIGS. 22 to 29. The physical and electrical configurations of the embroidery data creation apparatus 1, the configuration of the embroidery sewing machine 3, and the main processing, with the exception of the first edit processing, are the same as in the first embodiment. Therefore, explanations of those matters will be omitted from the explanation that follows. In the second embodiment, the content of the pattern information that is stored in the pattern table is different from what it is in the first embodiment. In the second embodiment, information (hereinafter called line segment information) that specifies given line segments (hereinafter called feature line segments) that are designated in the first pattern are stored as the pattern information in the pattern table. The feature line segments may, for example, be set by the user through the keyboard 21 and the mouse 22. FIG. 22 shows examples of feature line segments 127 that are designated in the first pattern 111. Within the human face that is depicted by the first pattern 111, line segments for the mouth, the bridge of the nose, and the cheeks, and a line segment that links the two eyes, have been designated as the feature line segments 127. The feature line segments are thus designated in portions where successive stitches of the first pattern are sewn. This makes it possible to align the directions of the stitches of the embroidery pattern that is to be sewn based on the created embroidery data to the directions of the feature line segments.

The line segment information for each of the feature line segments includes at least an angle characteristic. The angle characteristic is information that indicates a direction in which (an angle at which) a color of a pixel shows continuity when the color of the pixel is compared to colors of surrounding pixels. Details of the angle characteristic are described in Japanese Patent Application. Publication No. JP-A-2008-289517, for example, the relevant portion of which is incorporated herein by reference. It is possible to specify the position and the direction of the feature line segment using the angle characteristic. Note that the line segment information that specifies the feature line segment is not limited to the angle characteristic. For example, the feature line segment may also be specified using information that indicates the positions of a starting point and an ending point of the feature line segment.

The first edit processing in the second embodiment will be explained with reference to FIG. 23. The first pattern that was acquired at Step S12 of the main processing (refer to FIG. 7) is displayed on the display 24. The user inputs the feature line segments through the keyboard 21 and the mouse 22. The feature line segments are acquired (Step S101). The angle characteristics of the feature line segments that have been input are computed as the line segment information (Step S103). The computed line segment information is stored in the pattern table as the pattern information.

Note that the feature line segments may also be designated automatically by selecting the portions where successive stitches are sewn, based on the embroidery data for sewing the first pattern. The method that is used for selecting the portions where successive stitches are sewn may be the same as the method that is described in Japanese Patent Application Publication No. JP-A-2008-289517, for example, the relevant portion of which is incorporated herein by reference. The feature line segments may also be stored in the pattern table in advance. In that case, when the first pattern is selected at Step S12 (refer to FIG. 7), the corresponding line segment information may be acquired automatically by being read from the pattern table.

The second image that was acquired at Step S11 of the main processing (refer to FIG. 7) is acquired by being read from the second storage area 152 (Step S105). The angle characteristics are computed based on the second image (Step S107). Each of the computed angle characteristics indicates the direction in which a color of each of the pixels of the second image shows continuity. The angle characteristics can be specified by a method that is described in Japanese Patent Application Publication No. JP-A-2008-289517, for example, the relevant portion of which is incorporated herein by reference. The specified angle characteristics are stored in the second storage area 152.

One of the plurality of first area information sets that were specified at Step S33 of the area specification processing (refer to FIG. 10) and are stored in the RAM 12 is acquired (Step S109). One of the second area information sets that corresponds to the acquired first area information set is specified based on the correspondence relationships between the first feature points and the second feature points. The specified second area information set is acquired from the RAM 12 (Step S111).

A portion of the feature line segment that is located within the first partitioned area that is specified by the first area information set that was acquired at Step S109 is identified (hereinafter, the identified portion is called the first feature line segment). The line segment information that characterizes the identified first feature line segment is selected from the line segment information that is stored in the pattern table (hereinafter, the selected line segment information is called the first line segment information) (Step S113). The first line segment information is converted based on the positional relationships between the three first feature points that are included in the first area information set that was acquired at Step S109 and the three second feature points that correspond to the first feature points (Step S115). The method for converting the first line segment information may be the same method that is used in the first embodiment. The post-conversion first line segment information (hereinafter called the second line segment information) is stored in the RAM 12. The portion of the feature line segment that is specified by the second line segment information (hereinafter called the second feature line segment) is equivalent to the portion of the feature line segment that is located within the second partitioned area that is specified by the second area information set.

A specific example of the converting of the first line segment information into the second line segment information will be explained briefly. Position information that describes a plurality of points on the first feature line segment is specified based on the first line segment information. The position information that describes the plurality of points on the first feature line segment is converted based on the method that was explained using FIGS. 15 and 16. A line segment that connects the post-conversion plurality of points is equivalent to the second feature line segment. The angle characteristics for specifying the second feature line segment are computed. The computed angle characteristics are equivalent to the second line segment information.

A determination is made as to whether all of the first partitioned areas have been acquired at Step S109 and whether the processing has been performed to convert all of the first line segment information to the second line segment information (Step S117). In a case where an unacquired first partitioned area remains, that is, where an unconverted first line segment information remains (NO at Step S117), the processing returns to Step S109. In a case where all of the first line segment information has been converted to the second line segment information (YES at Step S117), the processing proceeds to Step S119.

Figure 24:
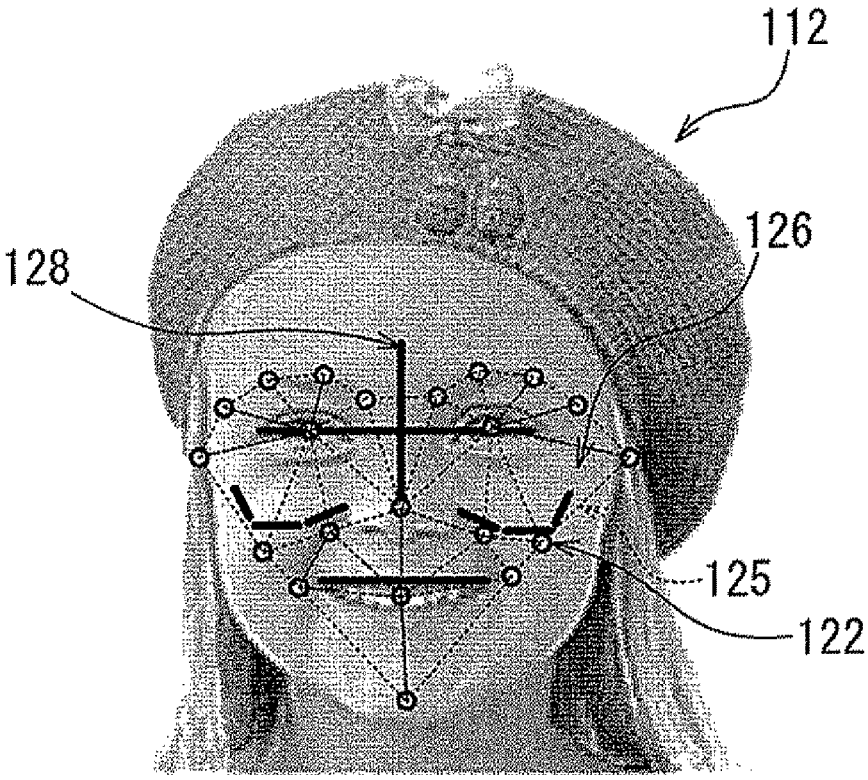
FIG. 24 is an explanatory figure of converted feature line segments 128 that are designated in the second image 112.

For example, for each of the feature line segments 127 that are designated in the first pattern 111 in FIG. 22, the first feature line segments that are located within the first partitioned areas 124 are respectively identified. The first line segment information for each of the identified first feature line segments is converted to the second line segment information. The second feature line segments that are specified by the second line segment information correspond to the second feature line segments that are located within the respective second partitioned areas 126 in FIG. 24. As shown in FIG. 24, a plurality of feature line segments (hereinafter called the converted feature line segments) 128, each of which is made up of the second feature line segments, are acquired by performing the processing described above for all of the first partitioned areas 124. The converted feature line segments 128 describe the line segments for the mouth, the bridge of the nose, and the cheeks, and a line segment that links the two eyes, in the human face that is depicted by the second image 112. The elements of the face that are designated by the converted feature line segments 128 match the elements of the face that are designated by the feature line segments 127 in FIG. 22.

Processing is performed that uses the directions of the acquired converted feature line segments to adjust the angle characteristics that were computed based on the second image at Step S107 (Steps S119 to S123). A distance from each of the converted feature line segments (hereinafter called the adjustment distance) for specifying a pixel area in the second image (hereinafter called the adjustment area) in which the adjustments will be performed using the directions of the converted feature line segments are acquired from the other data storage area 156 (Step S119). A level to which the individual angle characteristics will be adjusted (hereinafter called the adjustment level) based on the converted feature line segments is acquired from the other data storage area 156 (Step S121). The angle characteristics that were computed based on the second image are adjusted based on the converted feature line segments, the adjustment distance, and the adjustment level (Step S123).

Figure 25:
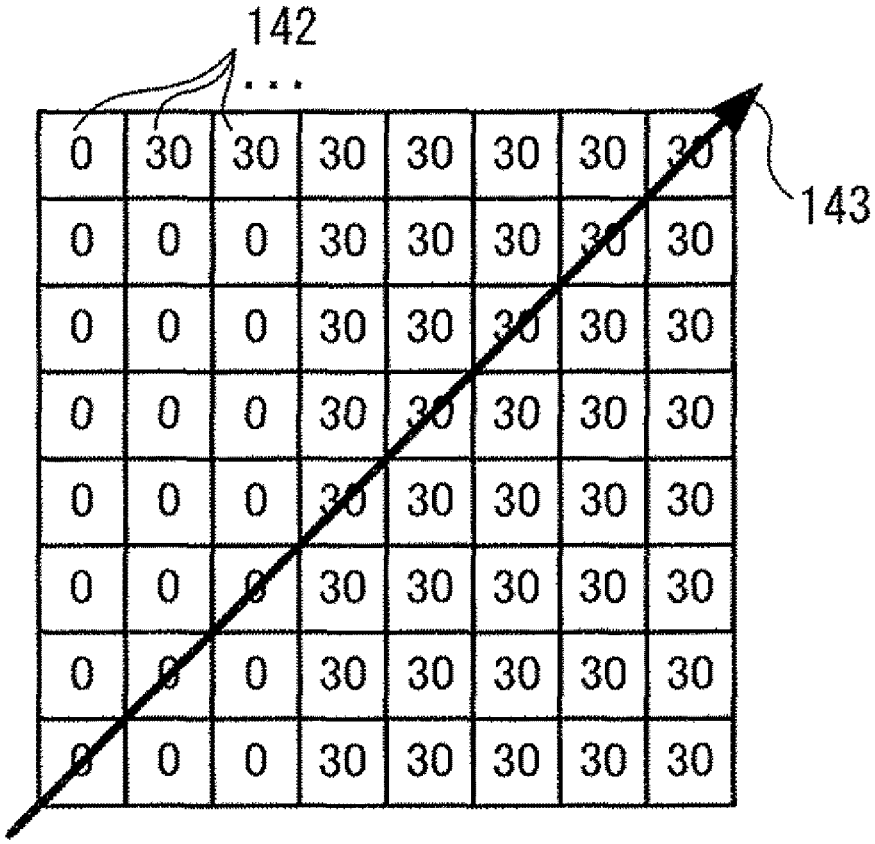
FIG. 25 is an explanatory figure that shows angle characteristics 142 and a converted feature line segment 143.
Figure 26:
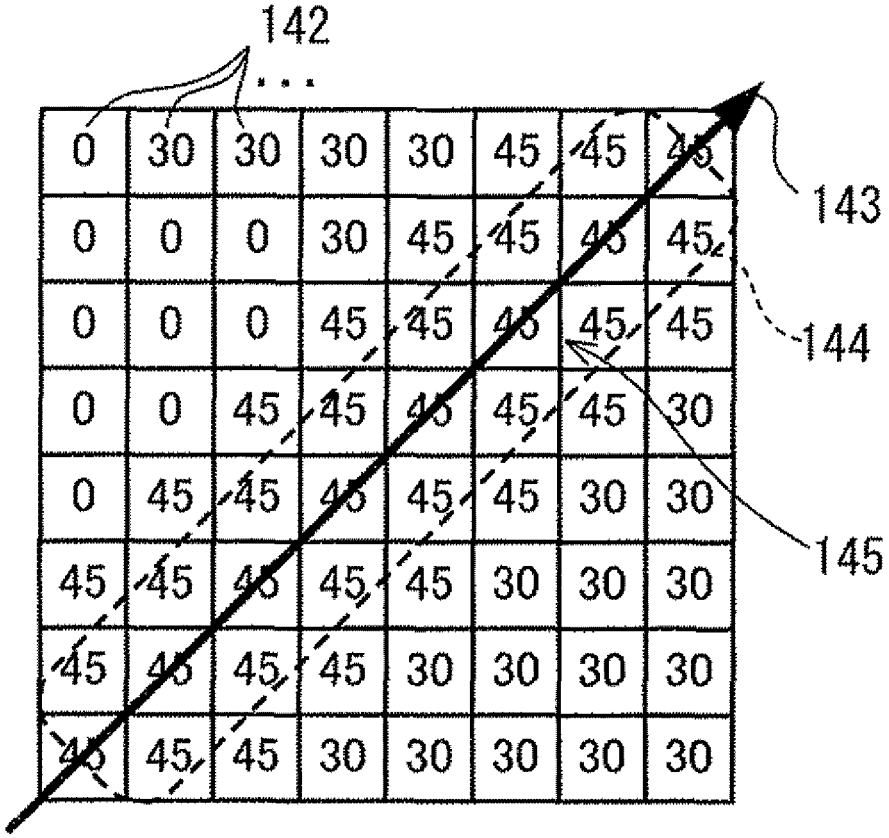
FIG. 26 is an explanatory figure of an adjustment area 144 and adjusted angle characteristics 145.

The method for adjusting the angle characteristics will be explained using a concrete example in which angle characteristics 142 are arranged in the form of a matrix, such that they correspond to the positions of the individual pixels, as shown in FIGS. 25 to 29. As shown in FIG. 25, each of the angle characteristics 142 includes information that indicates an angle (0, 30, 30, and the like). The individual values indicate the angles (in degrees) in relation to a horizontal line extending to the right. A converted feature line segment 143 is superimposed on the angle characteristics 142. The converted feature line segment 143 is disposed at a 45-degree angle, such that it extends diagonally from the lower left to the upper right.

At Step S119 (refer to FIG. 23), "one pixel" is acquired as the adjustment distance. At Step S121 (refer to FIG. 23), "100%" is acquired as the adjustment level. The area within the distance of one pixel from the converted feature line segment 143 is specified as an adjustment area 144. Because the adjustment level is 100%, the angle of the converted feature line segment 143 is reflected as is in angle characteristics 145 of all of the pixels within the adjustment area 144. The result is that the angle characteristics 145 are adjusted to the 45-degree angle of the converted feature line segment 143.

Figure 27:
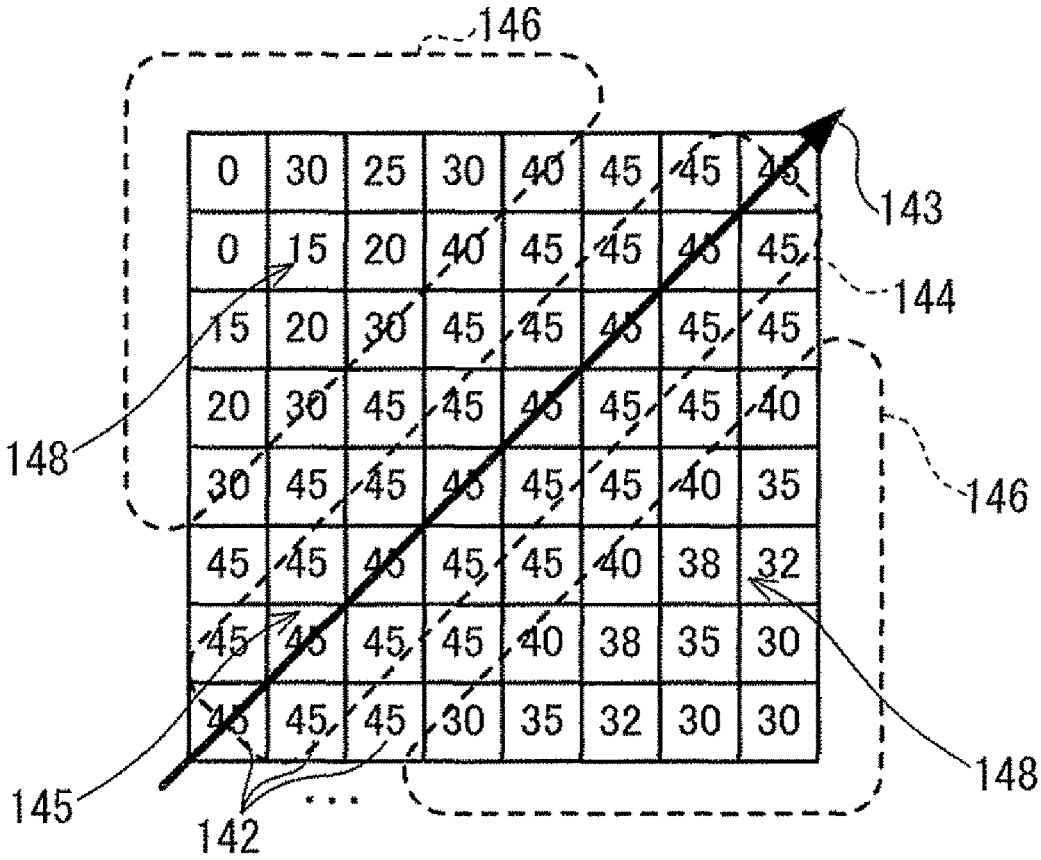
FIG. 27 is an explanatory figure of areas 146 and adjusted angle characteristics 148.

Next, angle characteristics 148 that are located within areas 146 to the outside of the adjustment area 144 are adjusted based on the adjusted angle characteristics 145, as shown in FIG. 27. The angle characteristics 148 are adjusted to new angle characteristics by taking into consideration the angle characteristics of the adjacent surrounding pixels. The method that is used for adjusting the angle characteristics 148 may be the same as the method that is described in Japanese Patent Application Publication No. JP-A-2008-289517, for example, the relevant portion of which is incorporated herein by reference. This makes it possible to smooth out the edges of the embroidery pattern that is sewn based on the created embroidery data.

Note that it is also acceptable not to perform the adjustment of the angle characteristics 148 that is described above. In that case, it is possible to make the edges stand out in the embroidery pattern that is sewn based on the created embroidery data.

Figure 28:
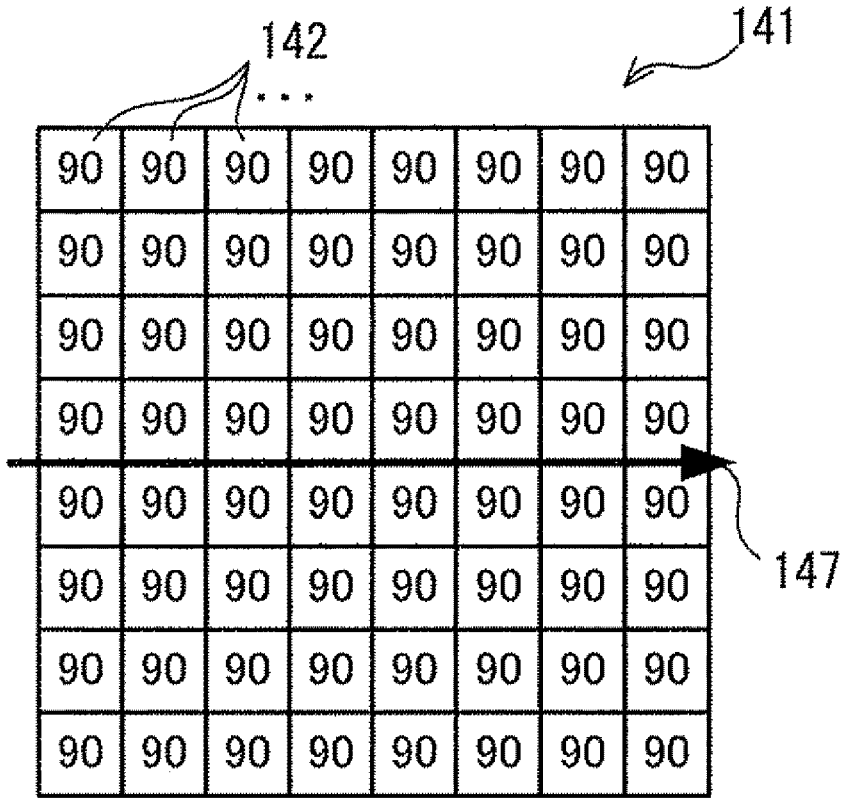
FIG. 28 is a separate explanatory figure that shows the angle characteristics 142 and a converted feature line segment 147.
Figure 29:
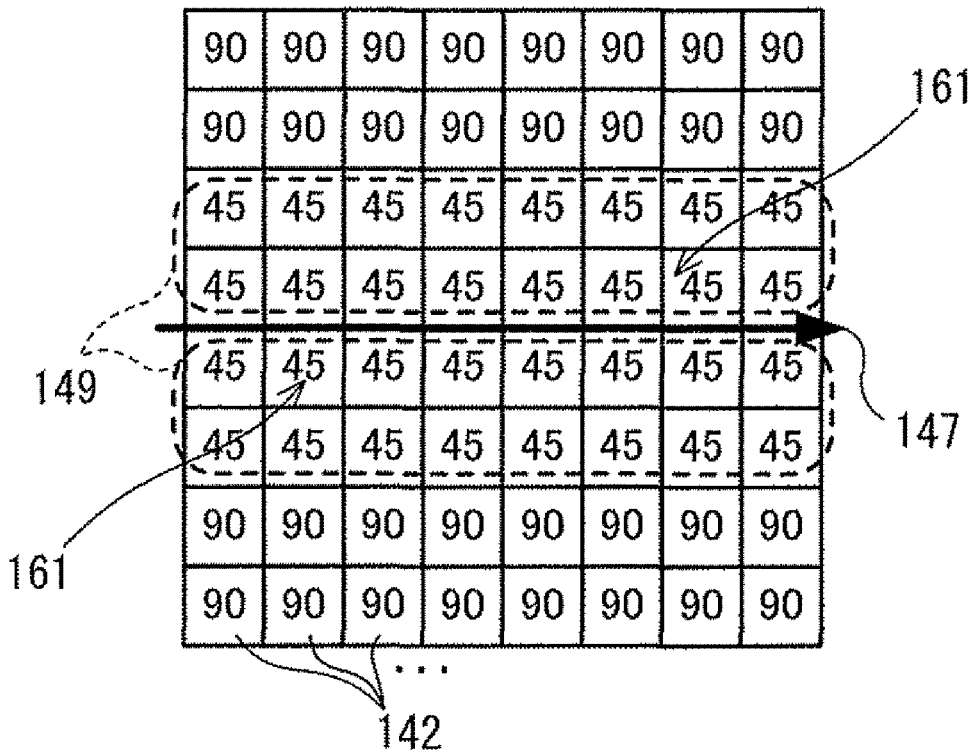
FIG. 29 is an explanatory figure of adjustment areas 149 and adjusted angle characteristics 161.

To take another example, in a case where all of the angle characteristics 142 are 90 degrees, a converted feature line segment 147 is oriented in the horizontal direction from left to right. FIG. 28 shows an example in which "0%" has been read as the adjustment level in this example. Because the adjustment level is 0%, the angle characteristics 142 are not adjusted according to the zero-degree angle of the converted feature line segment 147. In contrast, FIG. 29 shows an example in which "two pixels" has been read as the adjustment distance and "50%" has been read as the adjustment level. Areas within the distance of two pixels from the converted feature line segment 147 are specified as adjustment areas 149. Because the adjustment level is 50%, the zero-degree angle of the converted feature line segment 147 is reflected at the ratio of 50% in angle characteristics 161 of all of the pixels within the adjustment areas 149. Accordingly, the angle characteristics 161 are adjusted to 45 degrees.

Figure 23:
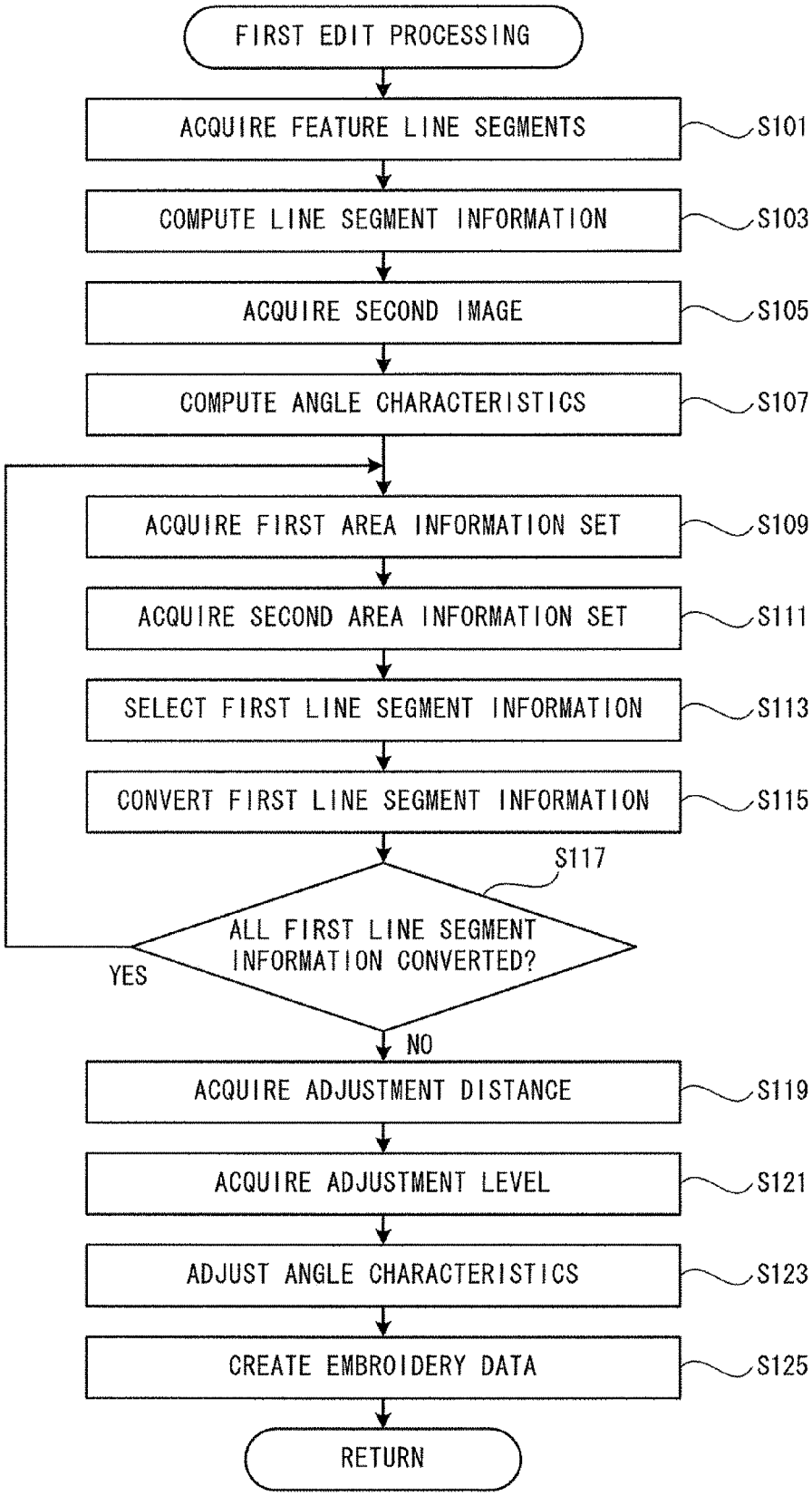
FIG. 23 is a flowchart of first edit processing in a second embodiment.

As shown in FIG. 23, after the angle characteristics that were acquired from the second image have been adjusted (Step S123), the sewing sequence, the needle drop points, and the thread colors are created based on the adjusted angle characteristics. Thus the embroidery data are created for sewing the embroidery pattern that is based on the second image (Step S125). Note that any known method may be used as the method for creating the embroidery data based on the angle characteristics. The method that is described in Japanese Patent Application Publication No. JP-A-2008-289517, the relevant portion of which is incorporated herein by reference, can be used. The created embroidery data may be stored in the embroidery data storage area 154, for example. The first edit processing is terminated, and the processing returns to the main processing (refer to FIG. 7).

As explained above, based on the direction (the angle) of the feature line segment that is designated in the first pattern, the embroidery data creation apparatus 1 can adjust the angle characteristics that are computed based on the second image. In a case where the direction of the feature line segment matches the direction of the stitches in the first pattern, the direction of the stitches in the embroidery pattern that will be sewn can approximate the direction of the stitches in the first pattern. Therefore, the embroidery data creation apparatus 1 can create the embroidery data that make it possible to sew the embroidery pattern that has a natural appearance.

The feature line segments are converted based on the positional relationships between the first feature points and the second feature points. Therefore, the quality of the stitches of the first pattern can be reproduced in the embroidery pattern without any sense of incongruity, even in a case where the first pattern and the second image differ significantly.

In the embroidery data creation apparatus 1, the adjustment distance and the adjustment level can be designated in a case where the angle characteristics will be adjusted in accordance with the converted feature line segment. The embroidery data creation apparatus 1 can adjust the finished quality of the embroidery pattern that is sewn based on the created embroidery data.

The present invention is not limited to the embodiments that are described above, and various types of modifications can be made. In the second embodiment described above, the adjustment distance and the adjustment level are stored in the other data storage area 156 in advance, but the present invention is not limited to that arrangement. For example, the user may input the adjustment distance and the adjustment level through the keyboard 21 and the mouse 22 immediately prior to adjusting the angle characteristics. The angle characteristics may then be adjusted based on the adjustment distance and the adjustment level that have been input.

The feature line segments may be designated uniformly over the entire first pattern, or the feature line segments may also be designated such that they are concentrated in a specific portion of the first pattern. Designating the feature line segments uniformly over the entire first pattern may make it possible to adjust the overall finished quality of the embroidery pattern to be sewn. Designating the feature line segments such that they are concentrated in a specific portion may make it possible to adjust the finished quality only in a desired area of the embroidery pattern.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data creation apparatus, comprising:

a storage portion that stores pattern information, the pattern information being information that characterizes a first pattern, the first pattern being a model embroidery pattern;

a first point specification portion that specifies a plurality of first feature points, each of the plurality of first feature points being a feature point in one of the first pattern and a first image, the first image being an image that serves as a basis for the first pattern;

a first area specification portion that specifies a plurality of first partitioned areas, each of the plurality of first partitioned areas being an area that is bounded by a plurality of first point linking line segments, each of the plurality of first point linking line segments being a line segment that links two of the plurality of first feature points specified by the first point specification portion;

an image acquisition portion that acquires a second image, the second image being an image that serves as a basis for a second pattern, the second pattern being an embroidery pattern that is actually to be sewn;

a second point specification portion that specifies a plurality of second feature points, each of the plurality of second feature points being a feature point in the second image acquired by the image acquisition portion, and positions of the plurality of second feature points respectively corresponding to positions of the plurality of first feature points;

a second area specification portion that specifies a plurality of second partitioned areas, each of the plurality of second partitioned areas being an area that is bounded by a plurality of second point linking line segments, each of the plurality of second point linking line segments being a line segment that links two of the plurality of second feature points specified by the second point specification portion;

a conversion portion that, based on positional relationships between the plurality of first feature points and the plurality of second feature points that respectively correspond to the plurality of first feature points, selects information included in the pattern information stored in the storage portion that corresponds to each of the plurality of first partitioned areas specified by the first area specification portion and converts the selected information into information that corresponds to each of the plurality of second partitioned areas specified by the second area specification portion; and a first creation portion that, based on the information that has been acquired by converting by the conversion portion and that corresponds to the plurality of second partitioned areas, creates embroidery data for sewing the second pattern.

2. The embroidery data creation apparatus according to claim 1, wherein the pattern information includes information that indicates positions of a plurality of first needle drop points to be used for sewing the first pattern, and the conversion portion converts first position information into second position information based on the positional relationships, the first position information being information that indicates positions, among the plurality of first needle drop points, of the first needle drop points that are located in each of the plurality of first partitioned areas, and the second position information being information that indicates positions, among a plurality of second needle drop points to be used for sewing the second pattern, of the second needle drop points that are located in each of the plurality of second partitioned areas that respectively correspond to the plurality of first partitioned areas.

3. The embroidery data creation apparatus according to claim 2, wherein the pattern information includes first sequence information, the first sequence information being information that indicates a sewing sequence for the plurality of first needle drop points, and the first creation portion creates the embroidery data by treating the first sequence information as second sequence information and by associating the second sequence information with the second position information, the second sequence information being information that indicates a sewing sequence for the plurality of second needle drop points that correspond to the plurality of first needle drop points, the embroidery data creation apparatus further comprising:

a first distance determination portion that, based on the second position information and the second sequence information, determines whether a distance between two successive second needle drop points is equal to or more than a first threshold value, the two successive second needle drop points being two second needle drop points to be used in succession in sewing, among the plurality of second needle drop points; and a first update portion that, in a case where the first distance determination portion has determined that the distance between the two successive second needle drop points is equal to or more than the first threshold value, defines as a new second needle drop point a point on a line segment that links the two successive second needle drop points, the new second needle drop point indicating a point to be used in sewing between the two successive second needle drop points, the first update portion then adding information that indicates a position of the new second needle drop point to the second position information and changing the second sequence information.

4. The embroidery data creation apparatus according to claim 2, wherein the pattern information includes first sequence information, the first sequence information being information that indicates a sewing sequence for the plurality of first needle drop points, and the first creation portion creates the embroidery data by treating the first sequence information as second sequence information and by associating the second sequence information with the second position information, the second sequence information being information that indicates a sewing sequence for the plurality of second needle drop points that correspond to the plurality of first needle drop points, the embroidery data creation apparatus further comprising:

a second distance determination portion that, based on the second position information and the second sequence information, determines whether a distance between two successive second needle drop points is less than a second threshold value, the two successive second needle drop points being two second needle drop points to be used in succession in sewing, among the plurality of second needle drop points; and a deletion portion that, in a case where the second distance determination portion has determined that the distance between the two successive second needle drop points is less than the second threshold value, deletes information that indicates a position of one of the two successive second needle drop points from the second position information and changes the second sequence information.

5. The embroidery data creation apparatus according to claim 2, wherein the pattern information includes first sequence information, the first sequence information being information that indicates a sewing sequence for the plurality of first needle drop points, the embroidery data creation apparatus further comprising:

an intersection determination portion that determines whether a sewing line segment intersects one of the plurality of first point linking line segments, the sewing line segment being a line segment that links two successive first needle drop points, the two successive first needle drop points being two first needle drop points to be used in succession in sewing, among the plurality of first needle drop points; and a second update portion that, in a case where the intersection determination portion has determined that the sewing line segment intersects one of the plurality of first point linking line segments, defines a point of intersection between the sewing line segment and the one of the plurality of first point linking line segments as a new first needle drop point, the new first needle drop point indicating a point to be used in sewing between the two successive first needle drop points, the second update portion then adding information that indicates a position of the new first needle drop point to the first position information, and wherein the conversion portion, after the second update portion has added the information for the new first needle drop point, converts the first position information into the second position information.

6. The embroidery data creation apparatus according to claim 1, further comprising:

a direction acquisition portion that, based on the second image acquired by the image acquisition portion, acquires direction information for each of a plurality of pixels included in the second image, the direction information indicating a direction in which a color of each of the plurality of pixel shows continuity, wherein the pattern information includes line segment information, the line segment information being information for specifying a given line segment that is defined in one of the first pattern and the first image, the conversion portion converts first line segment information into second line segment information based on the positional relationships, the first line segment information being information for specifying portions of the given line segment, each of the portions being located within one of the plurality of first partitioned areas, and the second line segment information being information for specifying portions of a line segment, each of the portions being located within one of the plurality of second partitioned areas that correspond to the plurality of first partitioned areas, and the first creation portion includes an adjustment portion that adjusts the direction information acquired by the direction acquisition portion, based on a direction that is specified by the second line segment information acquired by the converting by the conversion portion, and a second creation portion that creates the embroidery data based on the direction information adjusted by the adjustment portion.

7. The embroidery data creation apparatus according to claim 6, further comprising:

a first designation portion that, by designating a distance from the line segment specified by the second line segment information, designates an area in which the direction information will be adjusted, wherein the adjustment portion adjusts the direction information for pixels, among the plurality of pixels included in the second image, that are located within the area designated by the first designation portion.

8. The embroidery data creation apparatus according to claim 6, further comprising:

a second designation portion that designates a level of adjustment to be used when the direction information is adjusted based on the second line segment information, wherein the adjustment portion adjusts the direction information in accordance with the level designated by the second designation portion.

9. The embroidery data creation apparatus according to claim 1, further comprising:

a ratio acquisition portion that acquires a plurality of use ratios for a plurality of first pattern colors, the first pattern colors being colors of a plurality of threads that are to be used for sewing the first pattern;

a color specification portion that rearranges a color distribution of the second image based on the plurality of use ratios acquired by the ratio acquisition portion and specifies a plurality of average colors based on the rearranged color distribution, the plurality of average colors respectively corresponding to the plurality of first pattern colors; and a color setting portion that selects, from among a plurality of available thread colors, a plurality of colors that most closely approximate the plurality of average colors specified by the color specification portion, respectively, then sets the selected plurality of colors as colors of a plurality of threads to be used for sewing the second pattern.

10. The embroidery data creation apparatus according to claim 1, wherein the storage portion stores a plurality of sets of the pattern information, the plurality of sets respectively corresponding to a plurality of the first patterns, the first point specification portion specifies the plurality of first feature points in a pattern that is indicated by one of the plurality of sets of the pattern information stored in the storage portion, and the conversion portion, based on the one of the plurality of sets of the pattern information stored in the storage portion, selects the information that corresponds to each of the plurality of first partitioned areas that have been specified by the first area specification portion, and converts the selected information into the information that corresponds to each of the plurality of second partitioned areas specified by the second area specification portion.

11. The embroidery data creation apparatus according to claim 1, wherein the first image is an image that shows a human face.

12. A non-transitory computer-readable medium that stores an embroidery data creation program, the embroidery data creation program comprising instructions that, when executed, cause a computer to perform the steps of:

specifying a plurality of first feature points, each of the plurality of first feature points being a feature point in one of a first pattern and a first image, the first pattern being a model embroidery pattern, the first image being an image that serves as a basis for the first pattern;

specifying a plurality of first partitioned areas, each of the plurality of first partitioned areas being an area that is bounded by a plurality of first point linking line segments, each of the plurality of first point linking line segments being a line segment that links two of the plurality of first feature points;

acquiring a second image, the second image being an image that serves as a basis for a second pattern, the second pattern being an embroidery pattern that is actually to be sewn;

specifying a plurality of second feature points, each of the plurality of second feature points being a feature point in the second image and positions of the plurality of second feature points respectively corresponding to positions of the plurality of first feature points;

specifying a plurality of second partitioned areas, each of the plurality of second partitioned areas being an area that is bounded by a plurality of second point linking line segments, each of the plurality of second point linking line segments being a line segment that links two of the plurality of second feature points;

selecting information that is included in pattern information stored in a storage portion and that corresponds to each of the plurality of first partitioned areas and converting the selected information into information that corresponds to each of the plurality of second partitioned areas, based on positional relationships between the plurality of first feature points and the plurality of second feature points that respectively correspond to the plurality of first feature points, the pattern information being information that characterizes the first pattern; and creating embroidery data for sewing the second pattern, based on the information that has been acquired by converting and that corresponds to the plurality of second partitioned areas.

13. The computer-readable medium according to claim 12, wherein the pattern information includes information that indicates positions of a plurality of first needle drop points to be used for sewing the first pattern, and the converting of the information that corresponds to each of the plurality of first partitioned areas into the information that corresponds to each of the plurality of second partitioned areas converts first position information into second position information based on the positional relationships, the first position information being information that indicates positions, among the plurality of first needle drop points, of the first needle drop points that are located in each of the plurality of first partitioned areas, and the second position information being information that indicates positions, among a plurality of second needle drop points to be used for sewing the second pattern, of the second needle drop points that are located in each of the plurality of second partitioned areas that respectively correspond to the plurality of first partitioned areas.

14. The computer-readable medium according to claim 13, wherein the pattern information includes first sequence information, the first sequence information being information that indicates a sewing sequence for the plurality of first needle drop points, and the embroidery data are created by treating the first sequence information as second sequence information and by associating the second sequence information with the second position information, the second sequence information being information that indicates a sewing sequence for the plurality of second needle drop points that correspond to the plurality of first needle drop points, the embroidery data creation program further comprising instructions that cause the computer to perform the steps of:

determining, based on the second position information and the second sequence information, whether a distance between two successive second needle drop points is equal to or more than a first threshold value, the two successive second needle drop points being two second needle drop points to be used in succession in sewing, among the plurality of second needle drop points; and defining, as a new second needle drop point, in a case where it has been determined that the distance between the two successive second needle drop points is equal to or more than the first threshold value, a point on a line segment that links the two successive second needle drop points, the new second needle drop point indicating a point to be used in sewing between the two successive second needle drop points, then adding information that indicates a position of the new second needle drop point to the second position information and changing the second sequence information.

15. The computer-readable medium according to claim 13, wherein the pattern information includes first sequence information, the first sequence information being information that indicates a sewing sequence for the plurality of first needle drop points, and the embroidery data are created by treating the first sequence information as second sequence information and by associating the second sequence information with the second position information, the second sequence information being information that indicates a sewing sequence for the plurality of second needle drop points that correspond to the plurality of first needle drop points, the embroidery data creation program further comprising instructions that cause the computer to perform the steps of:

determining, based on the second position information and the second sequence information, whether a distance between two successive second needle drop points is less than a second threshold value, the two successive second needle drop points being two second needle drop points to be used in succession in sewing, among the plurality of second needle drop points; and deleting, from the second position information, in a case where it has been determined that the distance between the two successive second needle drop points is less than the second threshold value, information that indicates a position of one of the two successive second needle drop points, and changing the second sequence information.

16. The computer-readable medium according to claim 13, wherein the pattern information includes first sequence information, the first sequence information being information that indicates a sewing sequence for the plurality of first needle drop points, the embroidery data creation program further comprising instructions that cause the computer to perform the steps of:

determining whether a sewing line segment intersects one of the plurality of first point linking line segments, the sewing line segment being a line segment that links two successive first needle drop points, the two successive first needle drop points being two first needle drop points to be used in succession in sewing, among the plurality of first needle drop points; and defining, in a case where it has been determined that the sewing line segment intersects one of the plurality of first point linking line segments, a point of intersection between the sewing line segment and the one of the plurality of first point linking line segments as a new first needle drop point, the new first needle drop point being a point to be used in sewing between the two successive first needle drop points, then adding information that indicates a position of the new first needle drop point to the first position information, and wherein the first position information is converted into the second position information after the information for the new first needle drop point has been added.

17. The computer-readable medium according to claim 12, the embroidery data creation program further comprising instructions that cause the computer to perform the step of:

acquiring, based on the second image, direction information for each of a plurality of pixels included in the second image, the direction information indicating a direction in which a color of each of the plurality of pixels shows continuity, wherein the pattern information includes line segment information, the line segment information being information for specifying a given line segment that is defined in one of the first pattern and the first image, the converting of the information that corresponds to each of the plurality of first partitioned areas into the information that correspond to each of the plurality of second partitioned areas converts first line segment information into second line segment information based on the positional relationships, the first line segment information being information for specifying portions of the given line segment, each of the portions being located within one of the plurality of first partitioned areas, and the second line segment information being information for specifying portions of a line segment, each of the portions being located within one of the plurality of second partitioned areas that correspond to the plurality of first partitioned areas, and the creating of the embroidery data is performed by adjusting the direction information based on a direction that is specified by the second line segment information, and by creating the embroidery data based on the direction information that has been adjusted.

18. The computer-readable medium according to claim 17, the embroidery data creation program further comprising instructions that cause the computer to perform the step of:

designating an area in which the direction information will be adjusted, by designating a distance from the line segment specified by the second line segment information, wherein the direction information is adjusted for the pixels, among the plurality of pixels included in the second image, that are located within the area that has been designated.

19. The computer-readable medium according to claim 17, the embroidery data creation program further comprising instructions that cause the computer to perform the step of:

designating a level of adjustment to be used when the direction information is adjusted based on the second line segment information, wherein the direction information is adjusted in accordance with the level that has been designated.

20. The computer-readable medium according to claim 12, the embroidery data creation program further comprising instructions that cause the computer to perform the steps of:

acquiring a plurality of use ratios for a plurality of first pattern colors, the first pattern colors being colors of a plurality of threads that are to be used for sewing the first pattern;

rearranging a color distribution of the second image based on the plurality of use ratios and specifying a plurality of average colors based on the rearranged color distribution, the plurality of average colors respectively corresponding to the plurality of first pattern colors; and selecting, from among a plurality of available thread colors, a plurality of colors that most closely approximate the specified plurality of the average colors, respectively, then setting the selected plurality of colors as colors of a plurality of threads to be used for sewing the second pattern.

21. The computer-readable medium according to claim 12, wherein the storage portion stores a plurality of sets of the pattern information, the plurality of sets respectively corresponding to a plurality of the first patterns, the plurality of first feature points in a pattern that is indicated by one of the plurality of sets of the pattern information that are stored in the storage portion are specified, and the information that corresponds to each of the plurality of first partitioned areas that have been specified is selected, based on the one of the plurality of sets of the pattern information stored in the storage portion, and the selected information is converted into the information that corresponds to each of the plurality of second partitioned areas that have been specified.

22. The computer-readable medium according to claim 12, wherein the first image is an image that shows a human face.

* * * * *